US008544982B2

(12) United States Patent
Sakata et al.

(10) Patent No.: US 8,544,982 B2
(45) Date of Patent: Oct. 1, 2013

(54) LIQUID JET HEAD, LIQUID JET RECORDER AND METHOD FOR FILLING LIQUID JET HEAD WITH LIQUID

(75) Inventors: Akifumi Sakata, Chiba (JP); Kazuyoshi Tominaga, Chiba (JP); Ayako Kayama, Chiba (JP); Toshiaki Watanabe, Chiba (JP)

(73) Assignee: SII Printek Inc. (JP)

( * ) Notice: Subject to any disclaimer, the term of this patent is extended or adjusted under 35 U.S.C. 154(b) by 287 days.

(21) Appl. No.: 12/998,606

(22) PCT Filed: Aug. 20, 2009

(86) PCT No.: PCT/JP2009/064569

§ 371 (c)(1),
(2), (4) Date: Jun. 6, 2011

(87) PCT Pub. No.: WO2010/052964

PCT Pub. Date: May 14, 2010

(65) Prior Publication Data

US 2011/0234698 A1 Sep. 29, 2011

(30) Foreign Application Priority Data

Nov. 10, 2008 (JP) ..... 2008-288086

(51) Int. Cl.
*B41J 2/165* (2006.01)

(52) U.S. Cl.
USPC ..... 347/29; 347/22; 347/30

(58) Field of Classification Search
USPC ..... 347/22, 29–37, 40, 45–47, 60, 89–90
See application file for complete search history.

(56) References Cited

U.S. PATENT DOCUMENTS 6,305,778 B1 * 10/2001 Kobayashi et al. ..... 347/30
7,753,468 B2 * 7/2010 Endo et al. ..... 347/19

FOREIGN PATENT DOCUMENTS

JP 05116338 5/1993
JP 06218938 8/1994

* cited by examiner

*Primary Examiner* — Thinh Nguyen
(74) *Attorney, Agent, or Firm* — Adams & Wilks

(57) ABSTRACT

A liquid jet head has a nozzle plate with nozzle holes for ejecting a liquid. A wall portion surrounding the nozzle plate has an opening opposed to the nozzle holes. An opening and closing mechanism is configured in an open state to open the opening of the wall portion to expose the nozzle holes to an exterior of the head, and in a closed state to close the opening of the wall portion to form a closed space between the wall portion and the nozzle plate. A suction flow path has on one end side a suction port opening below the nozzle holes, and another end side is connected to a suction portion that evacuates the closed space to convert the closed space to a negative pressure chamber, thereby supplying the liquid to the nozzle holes. An atmosphere release portion switches between the open and closed states of the mechanism.

20 Claims, 15 Drawing Sheets

LIQUID JET HEAD, LIQUID JET RECORDER AND METHOD FOR FILLING LIQUID JET HEAD WITH LIQUID

CROSS-REFERENCE TO RELATED APPLICATIONS

This application is a U.S. national stage application of International Application No. PCT/JP2009/064569 filed Aug. 20, 2009, claiming a priority date of Nov. 10, 2008, and published in a non-English language.

BACKGROUND OF THE INVENTION

1. Technical Field

The present invention relates to a liquid jet head for jetting liquid from nozzles to record an image or text on a recording medium, a liquid jet recording apparatus, and a method of filling a liquid jet head with liquid.

2. Background Art

Generally, a liquid jet recording apparatus, for example, an ink jet printer which carries out various kinds of printing, includes a transfer apparatus for transferring a recording medium and an ink jet head. As an ink jet head used here, there is known an ink jet head including a nozzle body (jetting body) having a nozzle column (jetting hole column) formed of a plurality of nozzle holes (jetting holes), a plurality of pressure generating chambers which are paired with and communicate with the nozzle holes, respectively, an ink supply system for supplying ink to the pressure generating chambers, and a piezoelectric actuator disposed adjacent to the pressure generating chambers, in which the piezoelectric actuator is driven to pressurize the pressure generating chambers to cause ink in the pressure generating chambers to be jetted from nozzles in the nozzle holes.

As a kind of such an ink jet printer, there is known an ink jet printer in which a carriage for moving the ink jet head in a direction orthogonal to the direction of transfer of recording paper (recording medium) is provided and printing is carried out on the recording paper. In an inkjet printer of such a kind, a service station for maintenance is provided in a movable range of the ink jet head, and the ink jet head is moved to the service station at which the nozzle holes are cleaned and the ink jet head is capped and sucked under negative pressure to initially fill the nozzle holes with ink (so-called suction filling). For example, Patent Documents 1 and 2 described below disclose a structure in which ink in ink orifices of a recording head is sucked by a suction pump connected to a cap under a state in which the recording head and the cap are in abutment with each other.

Further, an ink jet printer of a kind which is different from the kind of the above-mentioned ink jet printer is used for a relatively large-sized recording medium such as a box and carries out printing on a recording medium which is transferred with an ink jet head being fixed. In an ink jet printer of this kind, the ink jet head cannot be moved, and there is not enough space for providing a service station between the ink jet head and a recording medium or below the ink jet head. Therefore, when the pressure generating chambers are initially filled with ink, ink is normally pressurized from the ink supply system side during being filled.

In this pressure-filling, in order to prevent contamination of the ink jet head and of places in proximity to the ink jet printer with excess ink which droops from the nozzle holes, and in order to prevent unstable jetting of ink after the filling of the ink, it is necessary to take measures of removing excess ink. As such measures, for example, as described in Patent Document 2, a structure is disclosed in which an ink guide member that is formed of a plate-like porous absorber and protrudes outward from a nozzle formation surface and a block-shaped ink absorber connected to the ink guide member are provided below the ink jet head, excess ink is received and guided to the ink absorber by the ink guide member, and the guided excess ink is absorbed by the ink absorber.

Patent Document 1: JP 06-218938 A

Patent Document 2: JP 05-116338 A

However, in the structure disclosed in Patent Document 2, there is a problem in that space below the inkjet head may not be effectively used because the ink guide member and the ink absorber are provided below the ink jet head. Another problem is in that, therefore, printing cannot be carried out on a lower portion of a recording medium. Still another problem is in that places around the head become dirty because the ability to collect excess ink is insufficient.

The present invention has been made in view of the above, and objects of the present invention are as follows:

(1) to improve a space factor of a liquid jet head to improve flexibility in designing a liquid jet recording apparatus; and (2) to improve ability to collect excess liquid with a simple structure to prevent contamination with excess liquid and to achieve initial filling of a liquid jet recording apparatus, to thereby stabilize jetting of liquid after the liquid is filled.

SUMMARY OF THE INVENTION

In order to achieve the objects described above, the present invention adopts the following techniques.

In one aspect, the present invention provides a liquid jet head including a jetting body having a jetting hole column formed of a plurality of jetting holes, a plurality of pressure generating chambers which are paired with and communicate with the plurality of jetting holes, respectively, a liquid supply system for supplying a first liquid to the plurality of pressure generating chambers and the plurality of jetting holes, and an actuator disposed adjacent to the plurality of pressure generating chambers, the actuator being driven to pressurize the plurality of pressure generating chambers, thereby causing the first liquid to be jetted from liquid nozzles of the plurality of jetting holes. The liquid jet head further includes: a wall portion provided so as to surround a periphery of the jetting body and having an opening opposed to the plurality of jetting holes; an opening and closing mechanism for, in an open state, opening the opening to expose the plurality of jetting holes to outside and for, in a closed state, closing the opening to form closed space between the wall portion and the jetting body; a suction flow path having, on one end side thereof, a suction port which is open below the jetting hole column while another end side thereof being connected to a sucking portion for, by sucking an inside of the closed space with the sucking portion, causing the closed space to become a negative pressure chamber to supply the first liquid from a supply source of the first liquid to the plurality of pressure generating chambers and to the plurality of jetting holes; and an atmosphere release portion which is switchable between communication of the closed space with the outside and interruption thereof.

According to the structure, by closing the opening in the wall portion with the opening and closing mechanism, the first liquid may be filled and excess liquid which flows out of the jetting body may be collected only through suction with the sucking portion via the suction flow path provided below the jetting hole column.

More specifically, by sucking with the sucking portion air in the closed space under a state in which space between the wall portion and the jetting body is caused to be the closed space by closing the opening, the closed space is depressurized to become a negative pressure chamber. This causes the first liquid to flow from the supply source of the first liquid into the jetting body, and thus, suction filling of the first liquid may be carried out. Further, by closing the opening, excess liquid which flows out of the jetting body in filling the first liquid may be prevented from flowing out of the opening. By, after the first liquid is filled, sucking air in the closed space with the sucking portion via the suction flow path under a state in which the atmosphere release portion is released, air passes via the atmosphere release portion from the outside toward the closed space, and thus, the first liquid of the supply source is not sucked and the pressure in the closed space recovers. After that, the air which flows from the outside into the closed space is discharged to the outside via the suction flow path. Here, excess liquid which flows out of the jetting body and accumulates in the closed space is, together with the air which passes through the closed space, discharged to the outside.

Therefore, contamination with excess liquid may be prevented with a simple structure and initial filling of the liquid jet recording apparatus may be achieved without providing a complicated service station as in a conventional case. Accordingly, jetting of the liquid after the liquid is filled may also be stabilized. Further, because excess liquid may be collected in the space inside the wall portion (closed space), the ability to collect excess liquid may be improved, and still, space used for collecting excess liquid may be extremely small, to thereby improve the space factor of the liquid jet head. This may improve the flexibility in designing the liquid jet head.

Further, in the liquid jet head, when the jetting hole column is disposed in a vertical direction, the atmosphere release portion is provided above and along a direction of arrangement of the jetting hole column.

According to the structure, by providing the atmosphere release portion above and providing the suction port below, air passes from above to below (toward the suction port) in the closed space, and thus, excess liquid in the closed space may be sucked reliably. Further, because excess liquid which flows out of the jetting body droops down in the direction of gravity from the jetting body, by providing the atmosphere release portion above, even if the atmosphere release portion is released when excess liquid accumulates in the closed space, the excess liquid is prevented from flowing out of the atmosphere release portion, and still, the closed space and the outside may communicate with each other.

Further, in the liquid jet head, the opening and closing mechanism includes a lid member supported by a hinge portion, the hinge portion being provided on the wall portion or a case for supporting the wall portion, the lid member being formed to be capable of opening and closing the opening with the hinge portion being the center of rotation.

According to the structure, by rotating the lid member via the hinge portion, opening and closing operation of the lid member may be carried out smoothly. By depressurizing the closed space between the wall portion or the case and the jetting body under this state, the closed space may reliably be the negative pressure chamber, and the ability to collect excess liquid may be improved.

Further, in the liquid jet head, the opening and closing mechanism includes urging means for urging the lid member in a direction of closing the opening.

According to the structure, by urging the lid member in a closing direction, the closing operation of the lid member may be carried out smoothly, and, when the lid member is in a closed state, the lid member is urged toward the wall portion. Therefore, intimate contact between the wall portion and the lid member may be secured, and the excess liquid may be reliably prevented from flowing out of the opening. This enables prevention of leakage of air from the opening, and the closed space may reliably be the negative pressure chamber. Therefore, compared with a case in which the suction is carried out under a state in which the opening is opened, the ability to collect excess liquid may be improved, and at the same time, initial filling may be carried out promptly.

Further, in the liquid jet head, the opening and closing mechanism includes a lid member which slides in directions of opening and closing the opening and a guide portion for guiding the lid member.

According to the structure, the opening may be opened and closed by sliding the lid member, and hence, compared with the structure in which the opening is opened and closed by rotating the lid member, a movable range of the opening and closing mechanism in the direction of the normal to the surface of the jetting body is small. More specifically, space used for placing the opening and closing mechanism may be reduced, and thus, the space factor may be further improved to improve the flexibility in designing the liquid jet recording apparatus.

Further, in the liquid jet head, the lid member is provided with a wiper member which is capable of being in sliding contact with a periphery of the jetting hole column of the jetting body in opening and closing operation.

According to the structure, the wiper member is in sliding contact with the surface of the jetting body following sliding operation (opening and closing operation) of the lid member, and hence, excess liquid attached to the surface of the jetting body and excess liquid which protrudes from the nozzles of the jetting holes due to surface tension may be collected at the same time of opening and closing the lid member. This makes it possible to effectively use the inside space of the wall portion to improve the space factor. Further, a wiper effect may be produced simultaneously with the opening and closing operation of the lid member, and hence, the operating efficiency may be improved without separately providing a wiping step after the first liquid is filled.

Further, in the liquid jet head, the lid member is formed to be slidable from below to above the jetting body in a direction of gravity.

According to the structure, it is also possible to stop the lid member in an engaged state halfway through the slide to be held under a state in which only an upper end portion of the opening is released. In this case, by releasing only the upper end portion of the opening from a state in which the opening is completely closed, the closed space between the wall portion and the jetting body communicates with the outside to be released to the atmosphere. More specifically, the opening and closing mechanism may serve as the atmosphere release portion, which eliminates the necessity to provide the atmosphere release portion separately. Therefore, the closed space may be released to the atmosphere without providing a valve or the like for the release to the atmosphere and without leakage of excess liquid which accumulates in the closed space. This allows a simpler structure of the liquid jet head to reduce the manufacturing cost.

Further, in the liquid jet head, a seal member is provided between the lid member in a state of closing the opening and the wall portion.

According to the structure, the intimate contact between the lid member and the wall portion may be improved, and hence, the excess liquid may be reliably prevented from flowing out of the opening. This enables prevention of leakage of air from the opening, and the closed space may reliably be the negative pressure chamber. Therefore, compared with a case in which the suction is carried out under a state in which the opening is opened, the ability to collect excess liquid may be improved, and at the same time, initial filling may be carried out promptly.

Further, as solving means related to the liquid jet head, there is adopted means in which a water-repellent film is formed on a surface of the lid member which is opposed to the jetting body in a state of closing the opening.

According to the structure, even if excess liquid attempts to leak to the outside from the opening, the excess liquid is repelled by the water-repellent film and is more likely to remain in the closed space, and thus, the ability to collect excess liquid is improved and excess liquid may be prevented from flowing out of the opening. Further, excess liquid may be prevented from remaining on the lid member, and hence, the vicinity of the liquid jet head may be prevented from being contaminated with excess liquid which remains on the lid member when the lid member is in the open state.

Further, in the liquid jet head, the wall portion includes a top plate portion, the top plate portion being disposed away from a surface of the jetting body and having the opening formed therein so as to be opposed to the jetting hole column, and an airtight portion for hermetically sealing space between a peripheral portion of the top plate portion and the jetting body.

According to the structure, by forming in the top plate portion the opening which is opposed to the jetting hole column, an area of the opening may be reduced and the movable range of the opening and closing mechanism may be small. Therefore, the space used for placing the opening and closing mechanism may be reduced.

In another aspect, the present invention provides a liquid jet recording apparatus that includes: any one of the foregoing liquid jet heads according to the present invention; and a liquid supply portion formed to be capable of supplying the first liquid to the liquid supply system.

According to the structure, any one of the liquid droplet jet heads adopting the above-mentioned solving means is included, and hence, first liquid stored in the liquid supply portion may be filled and excess liquid which flows out of the jetting body may be collected only through suction with a sucking portion via the suction flow path.

Therefore, contamination with excess liquid may be prevented with a simple structure and initial filling of the liquid jet recording apparatus may be achieved without providing a complicated service station as in a conventional case. Accordingly, jetting of the liquid after the liquid is filled may also be stabilized.

Further, in the liquid jet recording apparatus, the liquid supply portion is formed to be capable of switchedly supplying the first liquid and a second liquid to the liquid supply system.

According to the structure, because two kinds of liquid are supplied to the liquid supply system, for example, ink and a cleaning liquid may be switchedly supplied to the liquid supply system to reduce the labor of cleaning the liquid jet head and to carry out the cleaning efficiently.

Further, the liquid jet recording apparatus further includes the sucking portion which is connected to the suction flow path to cause the closed space to be a negative pressure chamber and which sucks the first liquid from the supply source of the first liquid.

According to the structure, it is not necessary to attach the sucking portion on the liquid jet head side, and hence, the structure of the liquid jet head may be simplified and the liquid jet head may be miniaturized.

Further, the liquid jet recording apparatus further includes a reuse liquid supply system for collecting by sucking the first liquid which overflows in the negative pressure chamber and for supplying the first liquid to the plurality of pressure generating chambers.

According to the present invention, the first liquid which overflows in the negative pressure chamber may be reused.

Further, in the liquid jet recording apparatus, the reuse liquid supply system includes a filter portion or a deaerator.

According to the present invention, liquid in an appropriate state may be reused.

In another aspect, the present invention provides a method of filling a liquid jet head with liquid, the liquid jet head including a jetting body having a jetting hole column formed of a plurality of jetting holes, a plurality of pressure generating chambers which are paired with and communicate with the plurality of jetting holes, respectively, a liquid supply system for supplying a first liquid to the plurality of pressure generating chambers and the plurality of jetting holes, and an actuator disposed adjacent to the plurality of pressure generating chambers, the actuator being driven to pressurize the plurality of pressure generating chambers, thereby causing the first liquid to be jetted from liquid nozzles of the plurality of jetting holes. The liquid jet head further includes a wall portion provided so as to surround a periphery of the jetting body and having an opening opposed to the plurality of jetting holes; an opening and closing mechanism for, in an open state, opening the opening to expose the plurality of jetting holes to outside and for, in a closed state, closing the opening to form closed space between the wall portion and the jetting body; a suction flow path having a suction port which is open below the jetting hole column of the jetting body for communicating with the closed space; a suction flow path having, on one end side thereof, a suction port which is open below the jetting hole column while another end side thereof being connected to a sucking portion for, by sucking an inside of the closed space with the sucking portion, causing the closed space to become a negative pressure chamber to supply the first liquid from a supply source of the first liquid; and an atmosphere release portion for communication between the closed space and the outside. The method of filling a liquid jet head with liquid includes the steps of: in the closed state of the opening and closing mechanism, carrying out interruption by the atmosphere release portion and carrying out suction filling of the first liquid from the supply source into the plurality of pressure generating chambers and the plurality of jetting holes with the sucking portion via the suction flow path; and after the suction filling of the first liquid, in the closed state of the opening and closing mechanism, causing the atmosphere release portion to communicate, and sucking with the sucking portion via the suction flow path an excess of the first liquid which exists in the closed space.

According to the structure, by closing the opening in the wall portion with the opening and closing mechanism, the first liquid may be filled and excess liquid which flows out of the jetting body may be collected only through suction with the sucking portion via the suction flow path provided below the jetting hole column.

More specifically, by sucking with the sucking portion air in the closed space under a state in which space between the wall portion and the jetting body is caused to be the closed space by closing the opening, the closed space is depressurized to be a negative pressure chamber. This causes the first liquid to flow from the supply source of the first liquid into the jetting body, and thus, suction filling of the first liquid may be carried out. Further, by closing the opening, excess liquid which flows out of the jetting body in filling the first liquid may be prevented from flowing out of the opening. By, after the first liquid is filled, sucking air in the closed space with the sucking portion via the suction flow path under a state in which the atmosphere release portion is released, air passes via the atmosphere release portion from the outside toward the closed space, and thus, the first liquid of the supply source is not sucked and the pressure in the closed space recovers. After that, the air which flows from the outside into the closed space is discharged to the outside via the suction flow path. Here, excess liquid which flows out of the jetting body and accumulates in the closed space is, together with the air which passes through the closed space, discharged to the outside.

Therefore, contamination with excess liquid may be prevented with a simple structure and initial filling of the liquid jet recording apparatus may be achieved without providing a complicated service station as in a conventional case. Accordingly, jetting of the liquid after the liquid is filled may also be stabilized. Further, because excess liquid may be collected in the space inside the wall portion (closed space), the ability to collect excess liquid may be improved, and still, space used for collecting excess liquid may be extremely small, to thereby improve the space factor of the liquid jet head. This may improve the flexibility in designing the liquid jet head.

According to the present invention, by closing the opening in the wall portion with the opening and closing mechanism, the first liquid may be filled and excess liquid which flows out of the jetting body may be collected only through suction with the sucking portion via the suction flow path provided below the jetting hole column.

More specifically, by sucking with the sucking portion air in the closed space under a state in which space between the wall portion and the jetting body is caused to be the closed space by closing the opening, the closed space is depressurized to be a negative pressure chamber. This causes the first liquid to flow from the supply source of the first liquid into the jetting body, and thus, suction filling of the first liquid may be carried out. Further, by closing the opening, excess liquid which flows out of the jetting body in filling the first liquid may be prevented from flowing out of the opening. By, after the first liquid is filled, sucking air in the closed space with the sucking portion via the suction flow path under a state in which the atmosphere release portion is released, air passes via the atmosphere release portion from the outside toward the closed space, and thus, the first liquid of the supply source is not sucked and the pressure in the closed space recovers. After that, the air which flows from the outside into the closed space is discharged to the outside via the suction flow path. Here, excess liquid which flows out of the jetting body and accumulates in the closed space is, together with the air which passes through the closed space, discharged to the outside.

Therefore, contamination with excess liquid may be prevented with a simple structure and initial filling of the liquid jet recording apparatus may be achieved without providing a complicated service station as in a conventional case. Accordingly, jetting of the liquid after the liquid is filled may also be stabilized. Further, because excess liquid may be collected in the space inside the wall portion (closed space), the ability to collect excess liquid may be improved, and still, space used for collecting excess liquid may be extremely small, to thereby improve the space factor of the liquid jet head. This may improve the flexibility in designing the liquid jet head.

DETAILED DESCRIPTION OF THE INVENTION

Embodiments of the present invention are described below with reference to the attached drawings.

First Embodiment (Liquid Jet Recording Apparatus)

Figure 1:
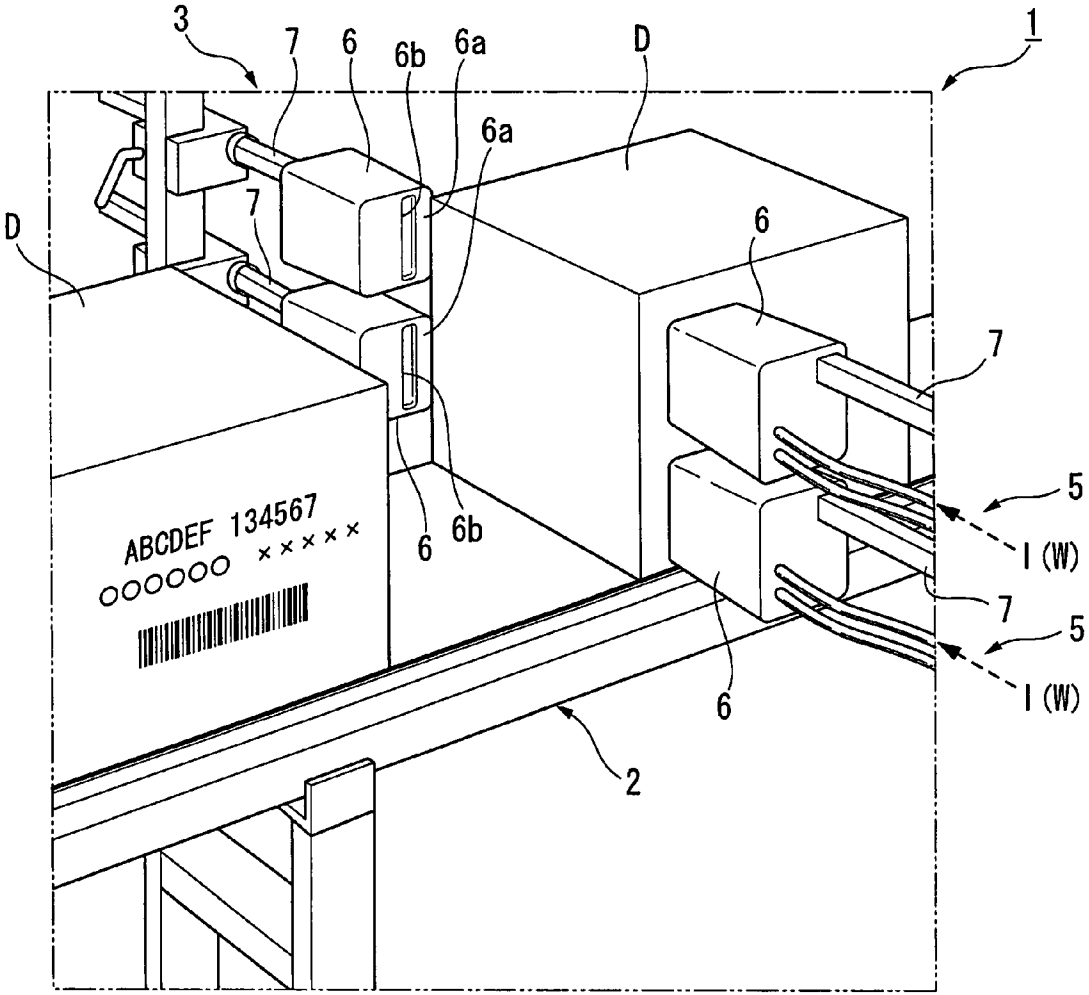
FIG. 1 is a perspective view illustrating an inkjet recording apparatus 1 according to an embodiment of the present invention.
Figure 2:
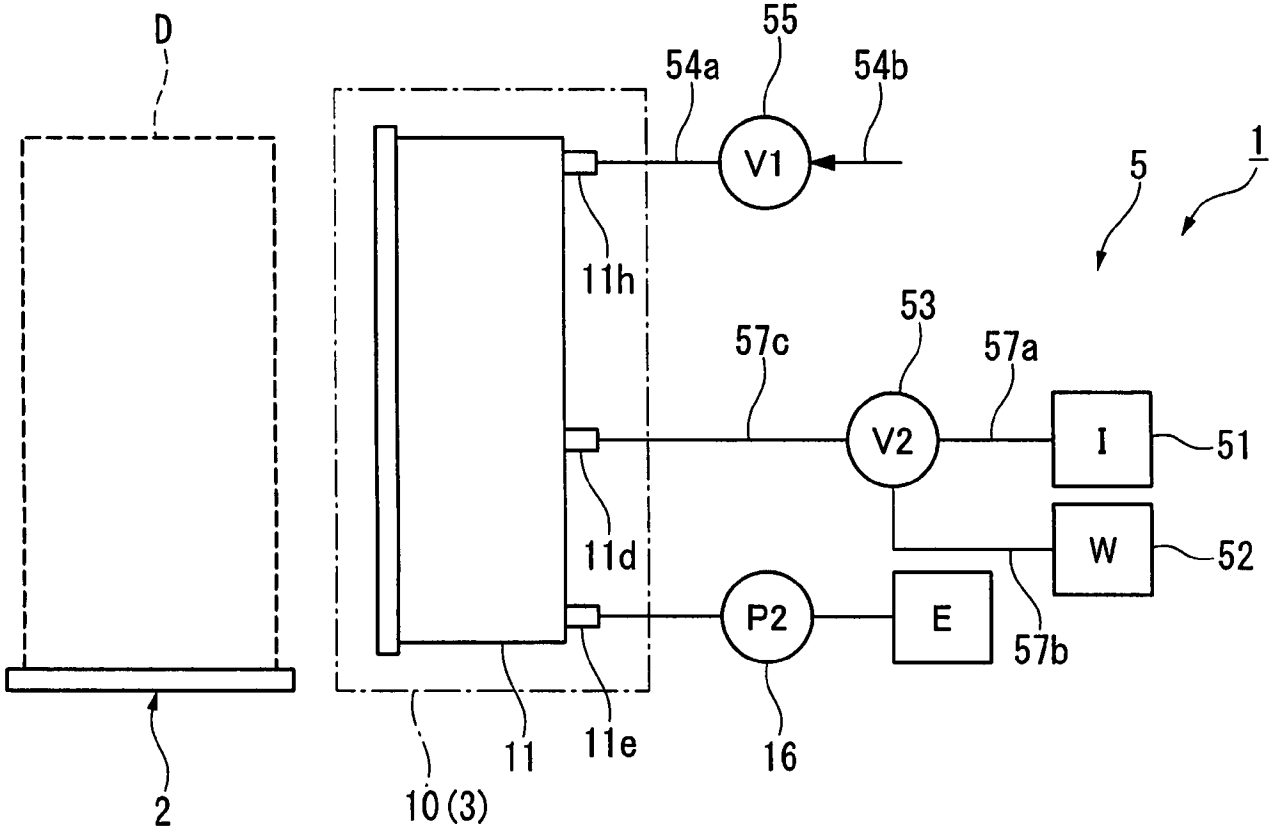
FIG. 2 is a schematic structural view of the ink jet recording apparatus 1 according to the embodiment of the present invention.

FIG. 1 is a perspective view illustrating an ink jet recording apparatus (liquid jet recording apparatus) 1 according to a first embodiment of the present invention. FIG. 2 is a schematic structural view of the inkjet recording apparatus 1. The inkjet recording apparatus 1 is connected to a predetermined personal computer, and carries out printing on a box D by, based on print data sent from the personal computer, discharging (jetting) ink (liquid) I. The ink jet recording apparatus 1 includes a belt conveyor 2 for transferring the box D in one direction, an ink discharging portion 3 including a plurality of ink jet heads (liquid jet heads) 10, an ink supply portion 5 for, as illustrated in FIG. 2, supplying the ink (first liquid) I and a cleaning liquid (second liquid) W to the ink jet head 10, and a suction pump (sucking portion) 16 connected to the ink jet head 10.

The ink discharging portion 3 discharges the ink I to the box D, and, as illustrated in FIG. 1, includes four enclosures 6 in the shape of rectangular parallelepipeds. The ink jet heads 10 are placed in the enclosures 6, respectively (see FIG. 2). The enclosures 6 are disposed in pairs on both sides of the belt conveyor 2 in a width direction with ink discharge surfaces 6*a* thereof being oriented to the belt conveyor 2 side, respectively. Two of the enclosures 6 disposed on both sides of the belt conveyor 2 in the width direction are vertically aligned with the other two of the enclosures 6 and all the enclosures 6 are supported by support members 7, respectively. It is to be noted that an opening 6*b* is formed in the ink discharge surface 6*a* of the enclosure 6.

(Liquid Jet Head)

Figure 3:
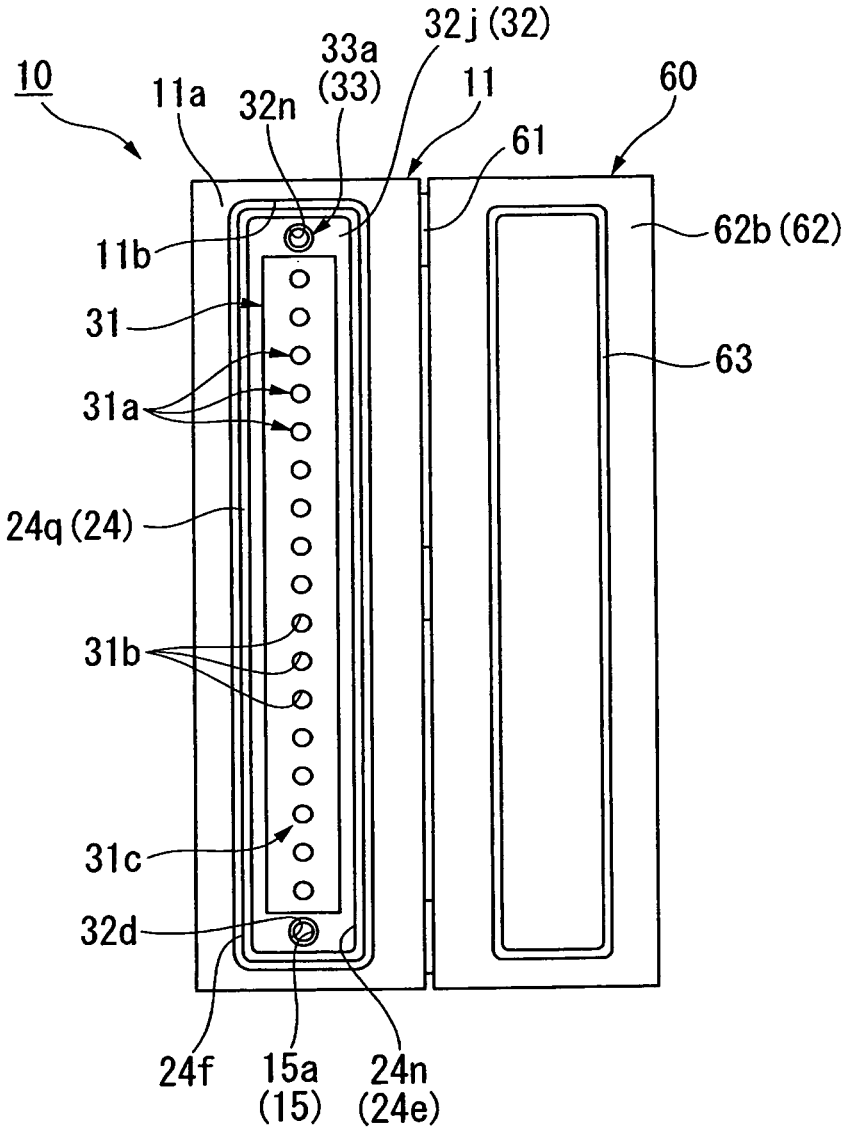
FIG. 3 is a front view of an ink jet head 10 according to a first embodiment of the present invention.
Figure 4:
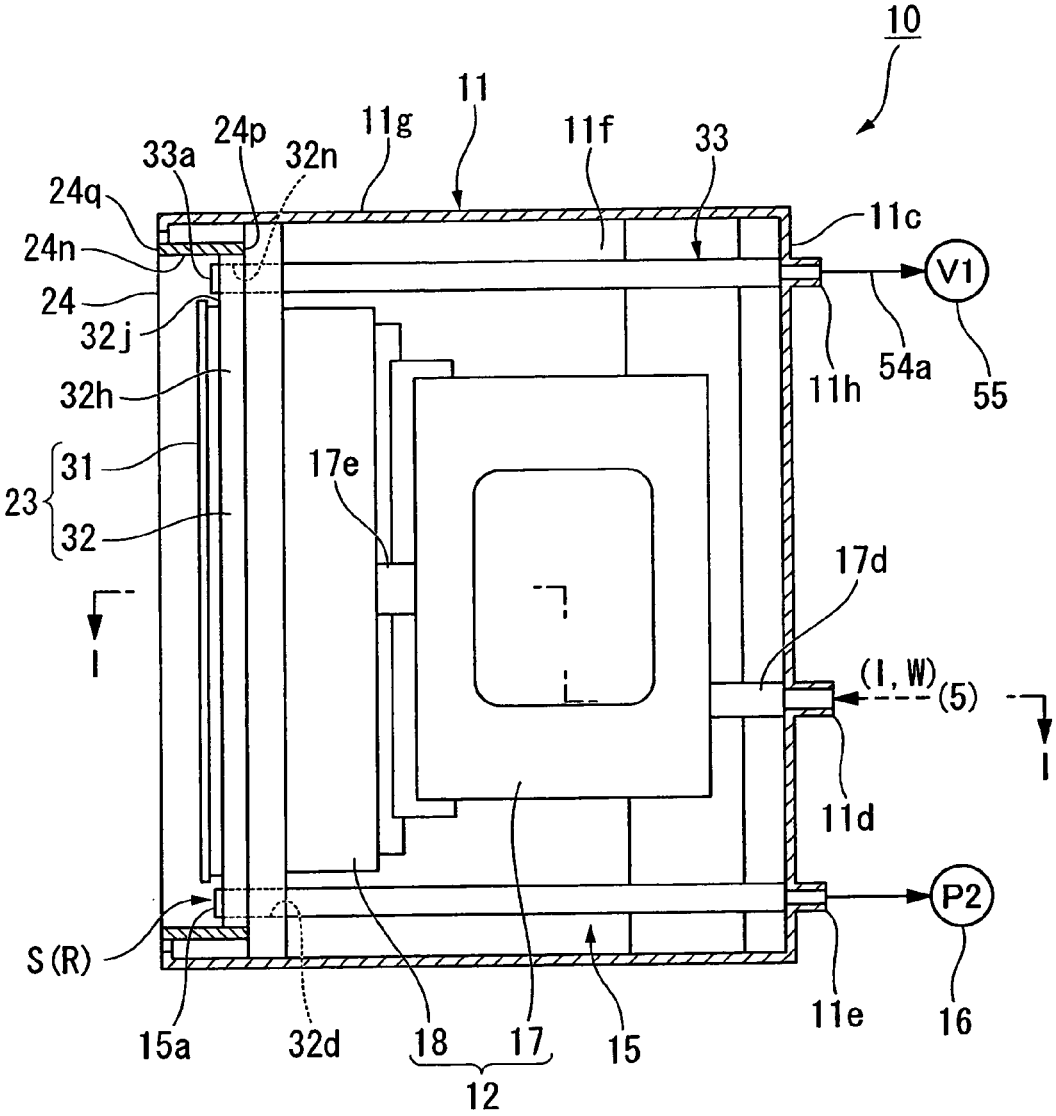
FIG. 4 is a schematic structural view of the ink jet recording apparatus 1 viewed from a right side according to the first embodiment of the present invention, in which a part of the structure is in section.
Figure 5:
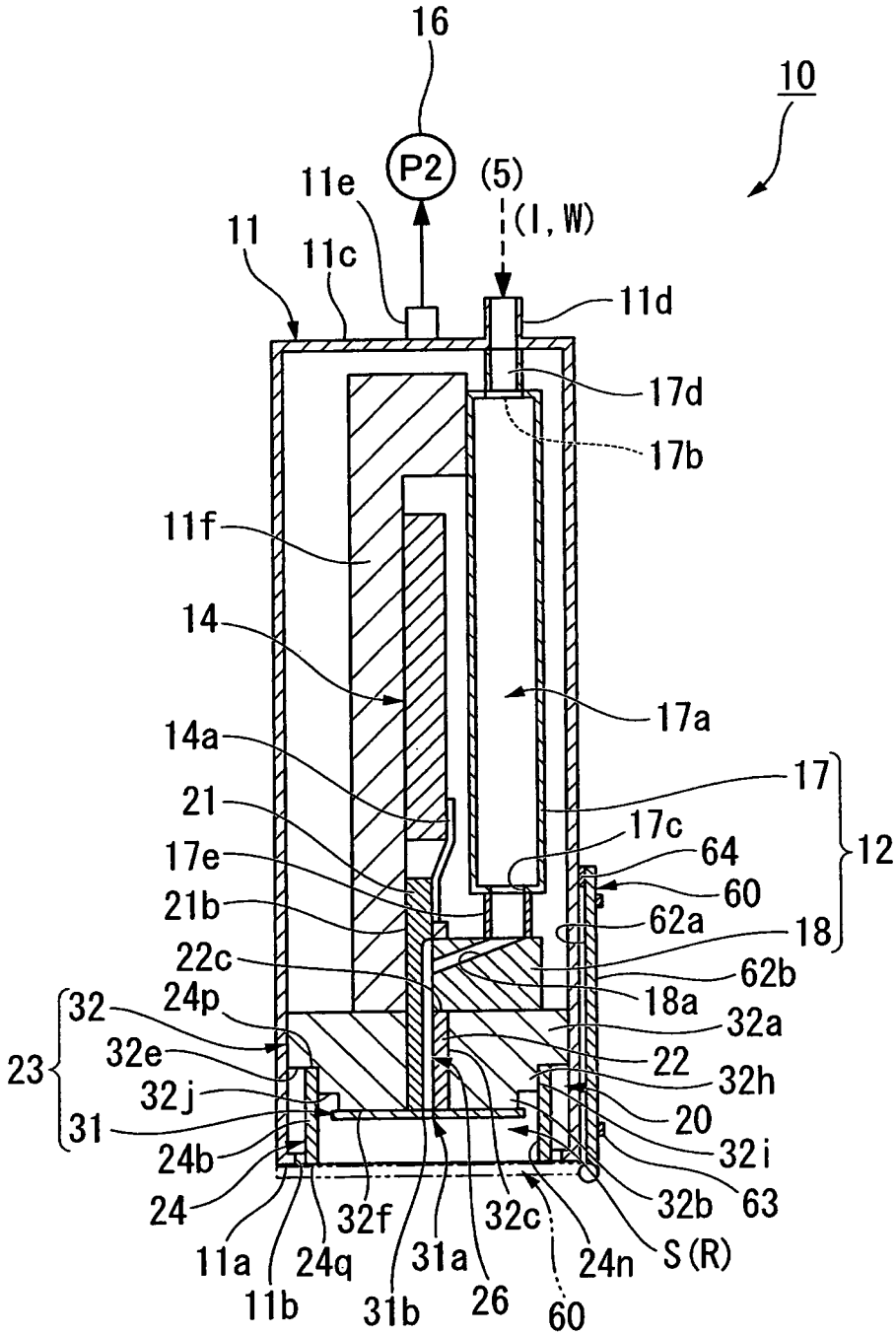
FIG. 5 is a sectional view taken along the line I-I of FIG. 4 in the first embodiment of the present invention.

FIG. 3 is a front view of the ink jet head 10. FIG. 4 is a schematic structural view of the ink jet head 10 viewed from a right side. FIG. 5 is a sectional view taken along the line I-I of FIG. 4.

As illustrated in FIG. 4, the ink jet head 10 includes a case 11, a liquid supply system 12, a head chip 20, a drive circuit board 14 (see FIG. 5), a suction flow path 15, and an atmosphere release flow path (atmosphere release portion) 33.

The case 11 is in the shape of a thin box with an exposure hole 11*b* formed in a front surface 11*a* thereof, and is fixed in the enclosure 6 with a thickness direction thereof being horizontal and with the exposure hole 11*b* oriented to the opening 6*b*. As illustrated in FIG. 4 and FIG. 5, through holes for communicating with internal space are formed in a back surface 11*c* of the case 11. More specifically, an atmosphere communication hole 11*h* is formed in an upper portion in a height direction, an ink injection hole 11*d* is formed in a substantially middle portion, and an ink suction hole 11*e* is formed in a lower portion. The case 11 includes, in the internal space thereof, a base plate 11*f* fixed to the case 11 so as to be upright, and houses structural items of the ink jet head 10.

The liquid supply system 12 communicates with the ink supply portion 5 via the ink injection hole 11*d*, and substantially formed of a damper 17 and an ink flow path substrate 18.

As illustrated in FIG. 5, the damper 17 is for the purpose of adjusting pressure fluctuations of the ink I, and includes a storing chamber 17*a* for storing the ink I. The damper 17 is fixed to the base plate 11*f* and includes an ink intake hole 17*b* connected to the ink injection hole 11*d* via a tube member 17*d* and an ink outflow hole 17*c* connected to the ink flow path substrate 18 via a tube member 17*e*.

The ink flow path substrate 18 is, as illustrated in FIG. 4, a member formed so as to be vertically long, and, as illustrated in FIG. 5, a member having a circulation path 18*a* formed therein, which communicates with the damper 17 and through which the ink I passes. The ink flow path substrate 18 is attached to the head chip 20.

As illustrated in FIG. 5, the drive circuit board 14 includes a control circuit (not shown) and a flexible substrate 14*a*. The drive circuit board 14 applies voltage to a ceramic piezoelectric plate (actuator) 21 according to a print pattern with one end of the flexible substrate 14*a* being joined to plate-like electrodes 28 to be described later and the other end being joined to a control circuit (not shown) on the drive circuit board 14. The drive circuit board 14 is fixed to the base plate 11*f*.

(Head Chip)

Figure 6:
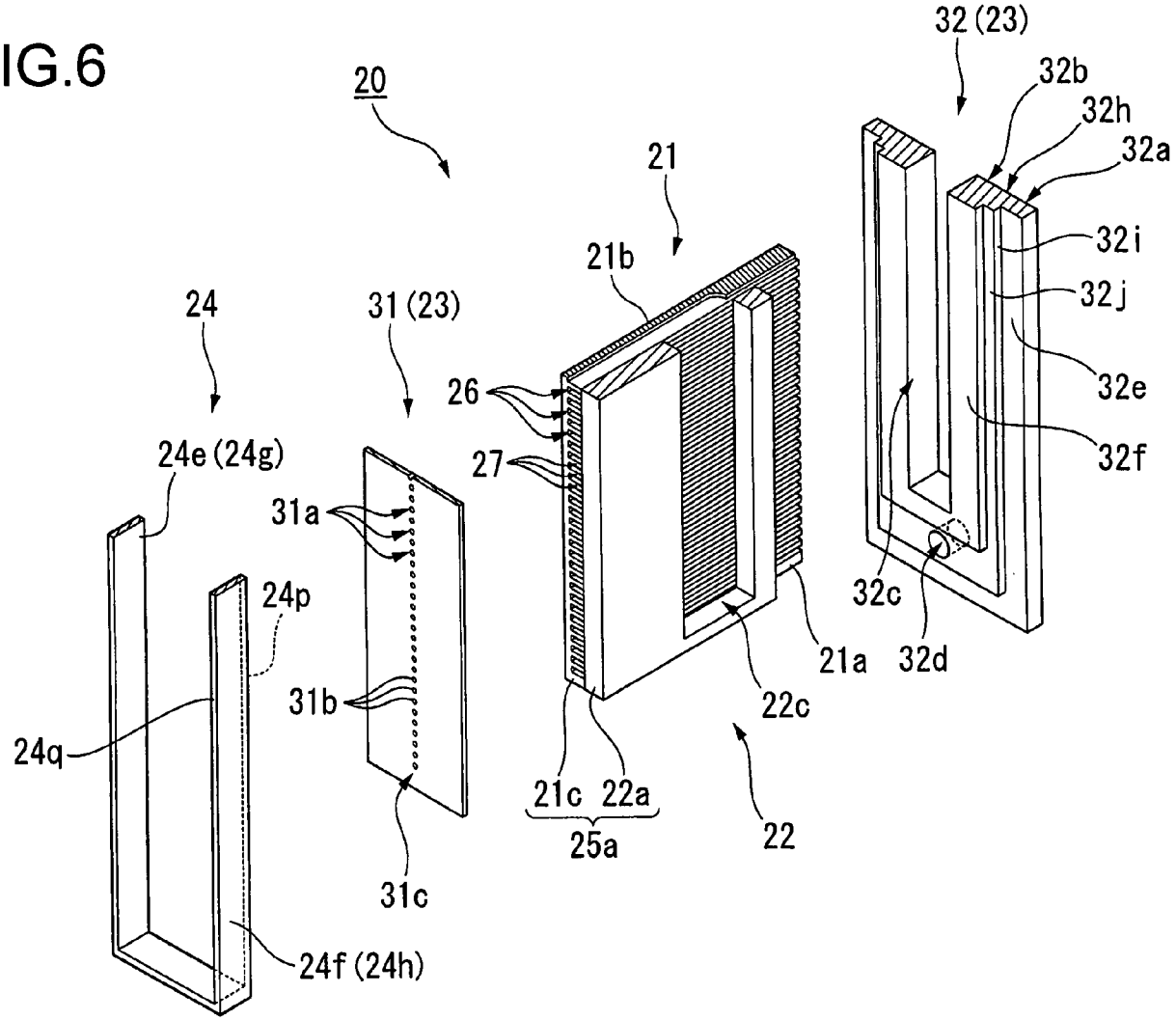
FIG. 6 is an exploded perspective view of a head chip 20 according to the embodiment of the present invention.
Figure 7:
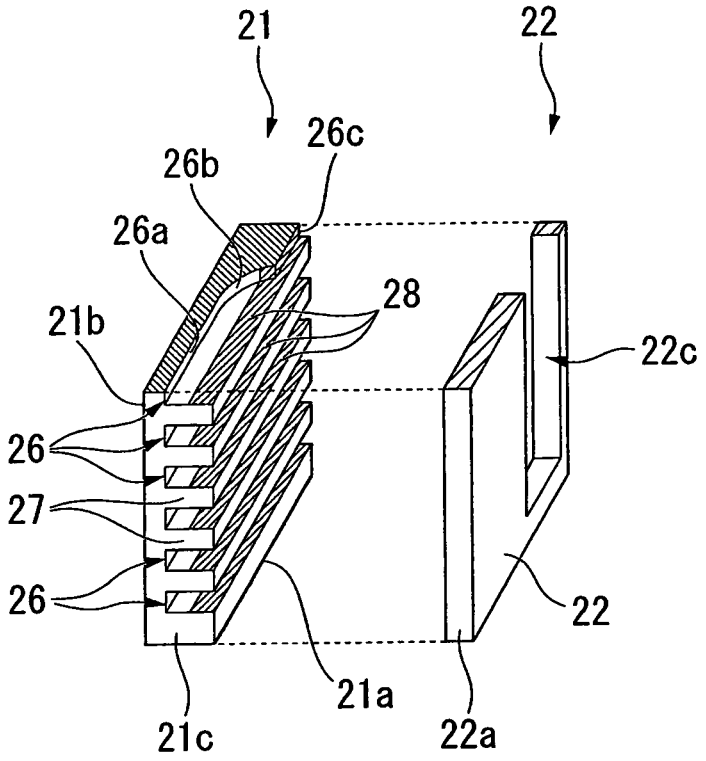
FIG. 7 is an exploded perspective view illustrating details of a ceramic piezoelectric plate 21 and an ink chamber plate 22 according to the embodiment of the present invention.

FIG. 6 is an exploded perspective view of the head chip 20. FIG. 7 is an exploded perspective view illustrating details of the ceramic piezoelectric plate 21 and an ink chamber plate 22. It is to be noted that, in FIG. 6, an opening and closing mechanism 60 (see FIG. 8) to be described later is omitted.

As illustrated in FIG. 6, the head chip 20 includes the ceramic piezoelectric plate 21, the ink chamber plate 22, a nozzle body (jetting body) 23, and a wall portion 24.

The ceramic piezoelectric plate 21 is a substantially rectangular plate-like member formed of lead zirconate titanate (PZT) and, as illustrated in FIG. 6 and FIG. 7, has a plurality of long grooves (pressure generating chambers) 26 provided on one plate surface 21*a* of two plate surfaces 21*a* and 21*b* thereof so as to be stacked on top of one another, and the respective long grooves 26 are isolated from one another by side walls 27.

As illustrated in FIG. 6, the long grooves 26 are provided so as to extend in a direction of a short side of the ceramic piezoelectric plate 21, and the plurality of long grooves 26 are provided so as to be stacked on top of one another over the whole length in a direction of a long side of the ceramic piezoelectric plate 21. As illustrated in FIG. 7, each of the long grooves 26 is formed so that its section in a thickness direction of the piezoelectric actuators is rectangular. Further, a bottom surface of each of the long grooves 26 includes a front flat surface 26*a* which extends from a front side surface 21*c* of the ceramic piezoelectric plate 21 to a substantially middle portion in the direction of the short side, a sloped surface 26*b* at which the depth of the groove gradually becomes smaller from an end of the front flat surface 26*a* toward a back side surface, and a back flat surface 26*c* which extends from an end of the sloped surface 26*b* toward the back side surface. It is to be noted that the respective long grooves 26 are formed with a disc-like dice cutter.

The plurality of side walls 27 are provided so as to be stacked on top of one another over the long side of the ceramic piezoelectric plate 21 for partitioning into the respective long grooves 26. The plate-like electrodes 28 for applying drive voltage are provided on the opening side of the long grooves 26 of wall surfaces of the side walls 27 (on the plate surface 21*a* side) so as to extend in the direction of the short side of the ceramic piezoelectric plate 21. The plate-like electrodes 28 are formed by publicly known oblique deposition. The above-mentioned flexible substrate 14*a* is joined to the plate-like electrodes 28.

As illustrated in FIG. 5, a portion of the plate surface 21*b* on the back side surface side of the ceramic piezoelectric plate 21 is fixed to an edge portion of the base plate 11*f*, and the long grooves 26 extend toward the exposure hole 11*b*.

Reference is made again to FIG. 6 and FIG. 7. The ink chamber plate 22 is, similarly to the ceramic piezoelectric plate 21, a substantially rectangular plate-like member. Compared with the size of the ceramic piezoelectric plate 21, the ink chamber plate 22 is formed so that its size in the direction of the long side is substantially the same as that of the ceramic piezoelectric plate 21 and its size in the direction of the short side is smaller than that of the ceramic piezoelectric plate 21. The ink chamber plate 22 includes an open hole 22*c* which passes through the thickness and which is formed over the long side of the ink chamber plate 22.

It is to be noted that, although the ink chamber plate 22 may be formed of a ceramic plate, a metal plate, or the like, taking into consideration deformation after being joined to the ceramic piezoelectric plate 21, a ceramic plate the coefficient of thermal expansion of which is similar thereto is used.

As illustrated in FIG. 6, the ink chamber plate 22 is joined to the ceramic piezoelectric plate 21 from the plate surface 21*a* side so that a front side surface 22*a* thereof and the front side surface 21*c* of the ceramic piezoelectric plate 21 are flush with each other and form an abutting surface 25*a*. In this joined state, the open hole 22*c* exposes the whole of the plurality of long grooves 26 of the ceramic piezoelectric plate 21, all the long grooves 26 are open to the outside, and the respective long grooves 26 are in a communicating state.

As illustrated in FIG. 5, the ink flow path substrate 18 is attached to the ink chamber plate 22 so as to cover the open hole 22*c*. The circulation path 18*a* in the ink flow path substrate 18 communicates with the respective long grooves 26.

As illustrated in FIG. 5, the nozzle body 23 is formed by sticking a nozzle plate 31 to a nozzle cap 32.

As illustrated in FIG. 6, the nozzle plate 31 is a thin-plate-like, strip-like member formed of polyimide or the like, and a plurality of nozzle holes 31*a* which pass through the thickness thereof line up to form a nozzle column 31*c*. More specifically, the nozzle holes 31*a* the number of which is the same as that of the long grooves 26 are formed in line at the middle in the direction of the short side of the nozzle plate 31 at the same intervals as those of the long grooves 26.

A water-repellent film which is water-repellent for the purpose of preventing adhesion of ink and the like is applied to, of two plate surfaces of the nozzle plate 31, a plate surface to which nozzle orifices (nozzles) 31*b* for discharging the ink I is open, while the other plate surface is a surface to which the abutting surface 25*a* and the nozzle cap 32 are joined.

It is to be noted that the nozzle holes 31*a* are formed using an excimer laser.

The nozzle cap 32 is a member in the shape of a frame-plate-like member with an outer periphery of one of two frame surfaces being cut away, and is a member including a thin-plate-like outer frame portion 32*a*, a middle frame portion 32*h* which is thicker than the outer frame portion 32*a*, an inner frame portion 32*b* which is thicker than the middle frame portion 32*h*, a long hole 32*c* which passes through the thickness at the middle portion in the direction of the short side of the inner frame portion 32*b* and which extends in the direction of the long side, and a discharge hole 32*d* which passes through the thickness at an end portion of the middle frame portion 32*h*. In other words, the middle frame portion 32*h* and the inner frame portion 32*b* protrude in the thickness direction from an outer frame surface 32*e* of the outer frame portion 32*a* so as to be step-like so that the contour of a section in the thickness direction is like stairs in which the heights of the outer frame portion 32*a*, the middle frame portion 32*h*, and the inner frame portion 32*b* become larger in this order toward the long hole 32*c*.

The nozzle plate 31 is stuck to an inner frame surface 32*f* which extends in the same direction as the outer frame surface 32*e* so as to block the long hole 32*c*. The wall portion 24 is in abutting contact with the outer frame surface 32*e* and with the outer frame surface 32*i* which extends from the outer frame surface 32*e* in a direction orthogonal to the outer frame surface 32*e*.

The nozzle body 23 is housed in the internal space of the case 11 so that the discharge hole 32*d* of the nozzle cap 32 is located on a lower side (see FIG. 3), and is fixed to the case 11 and the base plate 11*f* (see FIG. 5).

In this state, a part of the ceramic piezoelectric plate 21 and a part of the ink chamber plate 22 are inserted in the long hole 32*c* and the nozzle plate 31 is in abutment with the abutting surface 25*a*. Further, the nozzle plate 31 is adhered to the inner frame surface 32*f* by an adhesive. Compared with the area of the inner frame surface 32*f*, the area of the nozzle plate 31 is formed so as to be larger, and the nozzle plate 31 is disposed so as to extend beyond the edges of the inner frame surface 32*f* to some extent.

In such a structure, when a predetermined amount of the ink I is supplied from the storing chamber 17*a* in the damper 17 to the ink flow path substrate 18, the supplied ink I is fed via the open hole 22*c* into the long grooves 26. It is to be noted that a gap between the ink chamber plate 22 and the long grooves 26 on the back flat surface 26*c* side of the long grooves 26 (see FIG. 7) is sealed by a sealing material.

(Wall Portion)

The wall portion 24 is a member substantially in the shape of a frame formed of stainless steel. As described above, an edge 24*p* (hereinafter, referred to as back end portion 24*p*) side of the wall portion 24 is in abutting contact with the outer frame surface 32*e* and is fixed by an adhesive or the like. Further, the other edge 24*q* (hereinafter, referred to as front end portion 24*q*) side of the wall portion 24 extends from the back end portion 24*p* side in a direction substantially orthogonal to the nozzle plate 31, and the wall portion 24 surrounds the nozzle plate 31. Further, the front end portion 24*q* side of the wall portion 24 is formed so as to reach the surface of the front surface 11*a* of the case, and a wall portion release opening 24*n* the area of which is substantially the same as that of a middle frame surface 32*j* of the middle frame portion 32*h* is formed. Therefore, the whole surface of the nozzle plate 31 described above is exposed from the wall portion release opening 24*n* (see FIG. 3). A region surrounded by the wall portion 24 forms inside space S (hereinafter, referred to as space S) of the wall portion 24.

It is to be noted that a hydrophilic film 24*g* (see FIG. 6) is formed on the inner surface 24*e* of the wall portion 24 by titanium coating, while a water-repellent film (see FIG. 6) is formed on an outer surface 24*f* on the back of the inner surface 24*e* and on the end surface of the front end portion 24*q* by fluorine resin coating or Teflon (registered trademark) plating.

As illustrated in FIG. 4, in the suction flow path 15, one end of the tube to be a suction port 15*a* is inserted in and fixed to the discharge hole 32*d* while the other end is connected to the ink suction hole 11*e*.

Further, the suction pump 16 mounted outside the ink jet head 10 is connected to the ink suction hole 11*e* via a tube. In operation, the suction pump 16 sucks air and the ink I in the space S to cause the space S to become a negative pressure chamber R. It is to be noted that the suction pump 16 stores the sucked ink I in a waste liquid tank E (see FIG. 2). Further, the suction pump 16 may be mounted on the ink jet head 10, or, as in this embodiment, may be separate and included on the inkjet recording apparatus side. In this embodiment, the suction pump 16 is provided on the apparatus side, and hence, it is not necessary to attach the suction pump 16 on the ink jet head 10 side, which enables simplification of the structure of the ink jet head 10 and miniaturization of the ink jet head 10.

Here, the atmosphere release flow path 33 is provided in an upper portion of the middle frame portion 32*h* (on the side opposite to the discharge hole 32*d*), with one end thereof being inserted in and fixed to an open hole 32*n* which passes through the thickness of the middle frame portion 32*h* and the other end thereof being connected to the above-mentioned atmosphere communication hole 11*h* in the case 11. More specifically, the atmosphere release flow path 33 is formed above the uppermost nozzle hole 31*a* of the nozzle column 31*c*, with the one end thereof forming an atmosphere release opening 33*a* exposed to the space S of the wall portion 24. This enables the space S of the wall portion 24 to communicate with the outside via the atmosphere release flow path 33 and the atmosphere communication hole 11*h* in the case 11.

Reference is made again to FIG. 2. The ink supply portion 5 includes an ink tank (supply source) 51 in which the ink I is stored, a cleaning liquid tank 52 in which the cleaning liquid W is stored, and a changeover valve 53 which may switch between two flow paths.

The ink tank 51 and the cleaning liquid tank 52 are connected to the ink injection hole 11*d* via a supply tube 57*a*, the changeover valve 53, and a supply tube 57*c*, and via a supply tube 57*b*, the changeover valve 53, and the supply tube 57*c*, respectively. More specifically, the supply tubes 57*a* and 57*b* as inflow tubes and the supply tube 57*c* as an outflow tube are connected to the changeover valve 53.

Further, a tube 54*a* is connected to the atmosphere communication hole 11*h* in the case 11, and an atmosphere release valve 55 is connected to the atmosphere communication hole 11*h* via the tube 54*a*. The tube 54*a* as an outflow tube and a tube 54*b* as an inflow tube which communicates with the tube 54*a* via the atmosphere release valve 55 are connected to the atmosphere release valve 55. In the open state, the atmosphere release valve 55 enables the space S to communicate with the outside via the tubes 54*a* and 54*b*, the atmosphere communication hole 11*h*, and the atmosphere release opening 33*a*, while, in the closed state, the atmosphere release valve 55 interrupts the communication between the outside and the space S. More specifically, communication of the space S with the outside and interruption of the communication are able to be switched by the above-mentioned atmosphere communication hole 11*h* in the case 11, atmosphere release flow path 33 in the nozzle cap 32, and atmosphere release valve 55.

(Opening and Closing Mechanism)

Figure 8:
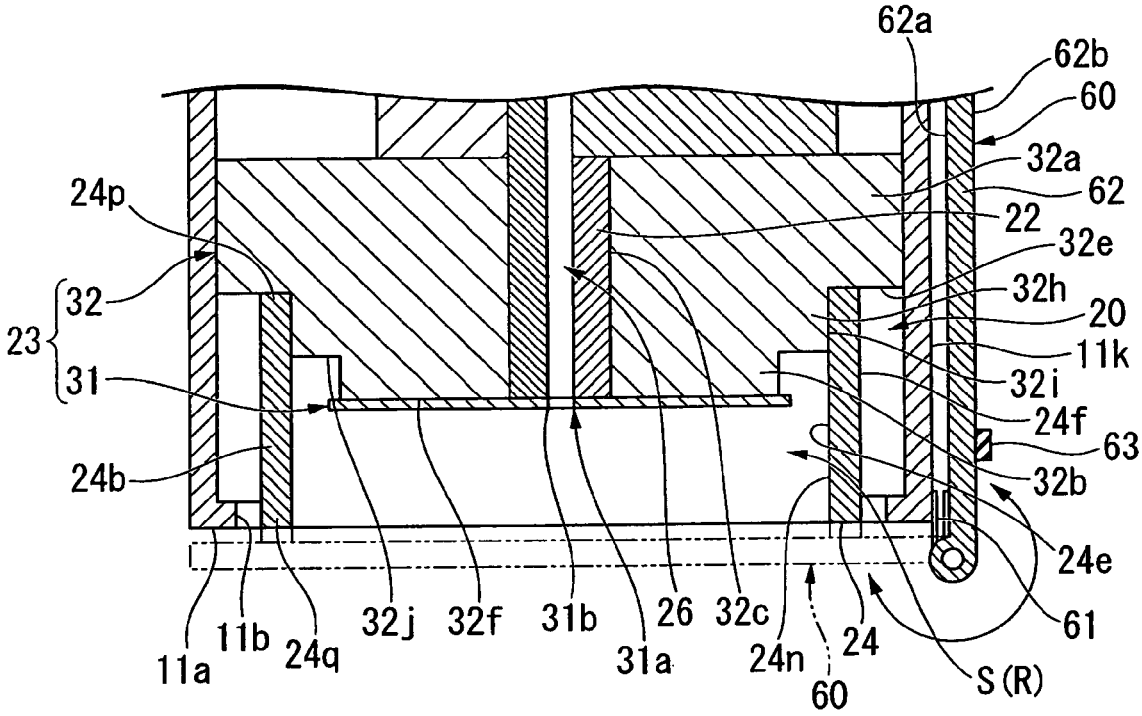
FIG. 8 is a sectional view of a principal part of the inkjet head according to the first embodiment of the present invention, which is an enlarged view corresponding to FIG. 5.

FIG. 8 is a sectional view of a principal part of the ink jet head and is an enlarged view corresponding to FIG. 5.

Here, as illustrated in FIG. 8, the opening and closing mechanism 60 is provided on a side of the wall portion release opening 24*n*, that is, on a side surface 11*k* of the case 11. The opening and closing mechanism 60 is supported by a hinge portion 61 provided on the side surface 11*k* of the case 11, and includes a door (lid member) 62 formed to be capable of opening and closing the wall portion release opening 24*n* in the wall portion 24 with the hinge portion 61 being the center of rotation, urging means (not shown) for urging the door 62 in a closing direction (in a direction of closing the wall portion release opening 24*n*), and a seal member 63 for sealing a gap between the door 62 in a state of closing the wall portion release opening 24*n* and the end surface on the front end portion 24*q* side of the wall portion 24.

The plurality of (for example, three) hinge portions 61 are arranged on the side surface 11*k* of the case 11 along the direction of the long side of the case 11, with one ends thereof being coupled to the side surface ilk of the case 11 and the other ends thereof being coupled to the door 62.

The door 62 is a flat plate in the shape of a rectangle seen in plan view and formed of a metal or the like, and the area of the door 62 is larger than the area of the opening of the wall portion release opening 24*n*. The other ends of the hinge portions 61 are coupled to an outer surface 62*a* of the door 62 (a surface of the door 62 located outside in the closed state), and the door 62 is formed to rotate by about 270 degrees (see the arrow of FIG. 8) with the hinge portions 61 being the center of rotation. The urging means such as a torsion spring for urging the door 62 in the closing direction is disposed between the hinge portions 61 and the door 62. Further, the above-mentioned water-repellent film (not shown) is formed on an inner surface 62*b* of the door 62 (a surface of the door 62 located inside in the closed state) by fluorine resin coating or Teflon (registered trademark) plating.

The seal member 63 is formed of an elastic material such as rubber, and is formed over the whole outer periphery of the inner surface 62*b* of the door 62. The seal member 63 is disposed so as to be, in the closed state of the door 62, in abutting contact with the whole periphery of the end surface of the front end portion 24*q* of the wall portion 24 to surround the wall portion release opening 24*n*. Further, a magnet 64 (see FIG. 5) which may attract the door 62 is disposed on the side surface 11*k* of the case 11. The magnet 64 is for the purpose of, in the open state of the door 62, fixing the door 62 in the open state by attracting the outer surface 62*a* of the door 62, and is disposed in the direction of the long side of the case 11.

More specifically, in the open state, the door 62 is formed to expose the nozzle holes 31*a* and the nozzle plate 31 to the outside by opening the wall portion release opening 24*n*, while, in the closed state, the door 62 is formed to close the wall portion release opening 24*n* so that the space S between the wall portion 24 and the nozzle plate 31 becomes closed space.

Next, operation of the ink jet recording apparatus 1 structured as described above is described. In the following, a case in which printing is carried out on the box D after the ink jet head 10 is initially filled with the ink I is described, and further, a case in which the ink jet head 10 is cleaned is described.

(Initial Filling of Ink)

Figure 9:
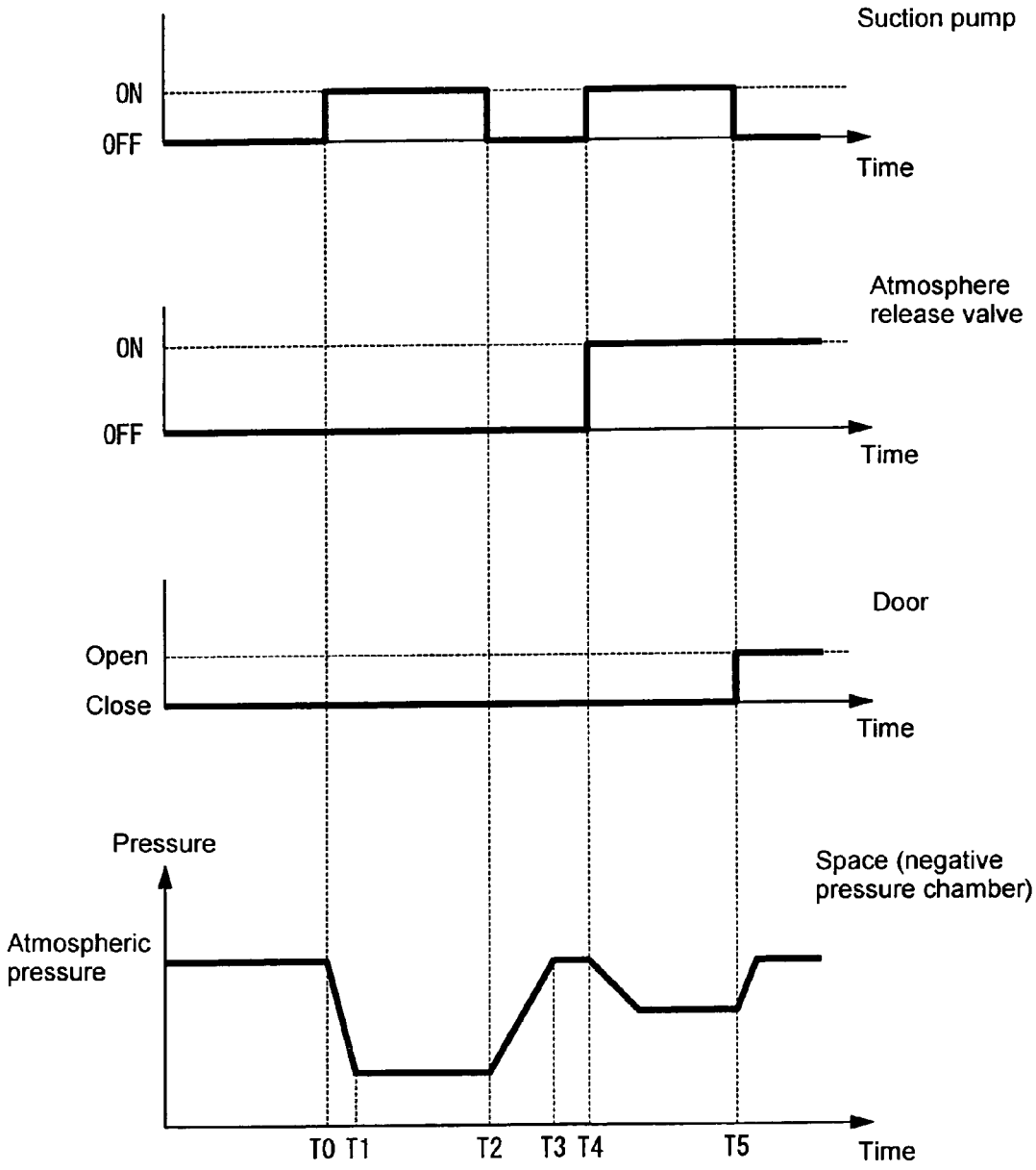
FIG. 9 shows graphs of a relationship among operation timing of a suction pump 16, operation timing of an atmosphere release valve, operation timing of an opening and closing mechanism (door), and space S (negative pressure chamber R) according to the embodiment of the present invention.
Figures 10A, 10B, 10C, 10D, 10E:
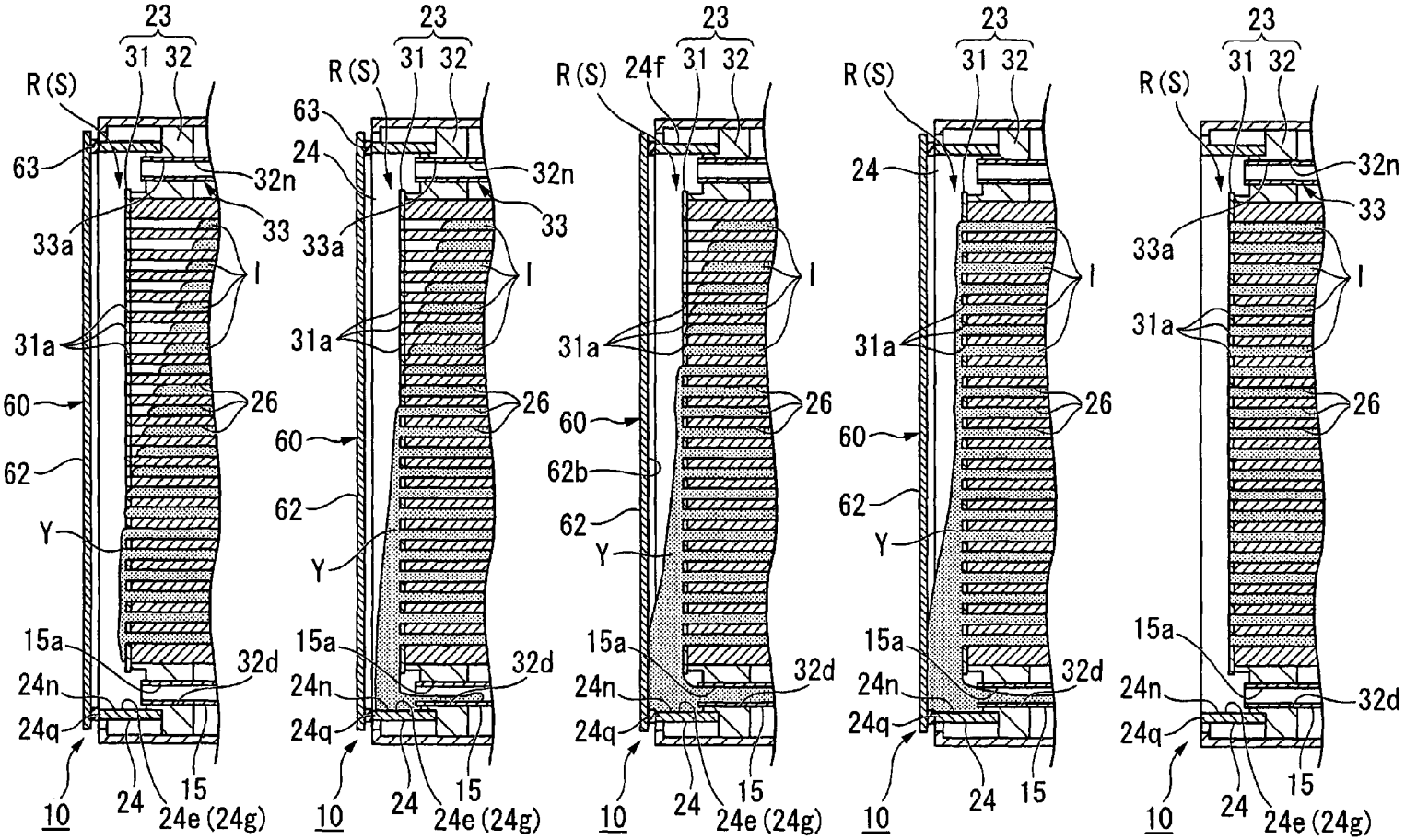
FIG. 10 are enlarged sectional views of a principal part of the head chip 20 illustrating operation of initial filling according to the embodiment of the present invention.

FIG. 9 shows graphs of a relationship among operation timing of the suction pump 16, operation timing of the atmosphere release valve 55, operation timing of the opening and closing mechanism 60 (door 62), and the space S (negative pressure chamber R). FIG. 10 are enlarged sectional views of a principal part of the head chip 20 illustrating operation of initial filling.

First, as illustrated in FIG. 4 and FIG. 9, the suction pump 16 is operated and the suction pump 16 sucks air in the space S from the suction port 15*a* via the suction flow path 15 (at time T0 of FIG. 9). Here, the atmosphere release valve 55 and the door 62 of the opening and closing mechanism 60 are closed so that the communication between the closed space and the outside is interrupted. Then, air in the space S is sucked from the suction port 15*a*, and hence, the space S is depressurized. After a predetermined time passes, at T1, the space S becomes the negative pressure chamber R in which the pressure becomes negative enough compared with atmospheric pressure.

When the space S becomes the negative pressure chamber R, suction filling of the ink I from the ink tank 51 of the ink supply portion 5 is carried out. More specifically, as illustrated in FIG. 2, by communicating the supply tube 57*a* with the supply tube 57*c* by the changeover valve 53, the ink I to be filled from the ink tank 51 is injected from the ink tank 51 via the supply tubes 57*a* and 57*c* into the ink injection hole 11*d* of the ink jet head 10.

As illustrated in FIG. 4 and FIG. 5, the ink I injected into the ink injection hole 11*d* flows in the storing chamber 17*a* via the ink intake hole 17*b* in the damper 17, and then, flows out to the circulation path 18*a* in the ink flow path substrate 18 via the ink outflow hole 17*c*. Then, the ink I which flows in the circulation path 18*a* flows in the respective long grooves 26 via the open hole 22*c*.

The ink I which flows in the respective long grooves 26 flows to the nozzle hole 31*a* side, and, after reaching the nozzle holes 31*a*, as illustrated in FIG. 10(*a*), flows out from the nozzle holes 31*a* as excess ink Y. At the beginning of the outflow of the excess ink Y, the excess ink Y flows downward on the nozzle plate 31 because the amount is small. The ink I which reaches a lower portion of the negative pressure chamber R is sucked from the suction port 15*a* into the suction flow path 15, and is discharged to the waste liquid tank E (see FIG. 10(*b*)).

When the amount of the excess ink Y which flows out becomes large, as illustrated in FIG. 10(*b*), the excess ink Y flows down not only on the nozzle plate 31 but also on the inner surface 24*e* of the wall portion 24. Here, the atmosphere release valve 55 and the door 62 are closed, the negative pressure chamber R forms closed space, and air is continuously sucked from the negative pressure chamber R with the suction pump 16, and hence, the excess ink Y does not flow out of the wall portion release opening 24*n* to the outside. Supposing the amount of the excess ink Y which flows on the inner surface 24*e* on the front end portion 24*q* side of the wall portion 24 becomes locally large and a part of the excess ink Y reaches the inner surface 62*b* of the door 62 as illustrated in FIG. 10(*c*), the excess ink Y is repelled by the water-repellent film formed on the inner surface 62*b* of the door 62. The repelled ink I is guided by the hydrophilic film 24*g* formed on the inner surface 24*e* of the wall portion 24 and returns to the negative pressure chamber R again.

After the long grooves 26 are filled to some extent with the ink I, the suction pump 16 is once stopped (at T2 of FIG. 9). Then, air still passes from the suction port 15*a* toward the discharge hole 32*d*, and hence, the pressure in the negative pressure chamber R attempts to recover and to again become atmospheric pressure. As a result, as illustrated in FIG. 10(*d*), the excess ink Y overflows from, among the nozzle holes 31*a*, a nozzle hole 31*a* with regard to which filling of the ink I is completed, while the ink I is filled to a tip of a nozzle hole 31*a* with regard to which filling of the ink I is not completed yet.

In this way, the ink I is filled into the whole of the long grooves 26 and the nozzle holes 31*a*. After a predetermined time passes, at T3, the pressure in the negative pressure chamber R recovers and again becomes substantially the same pressure as the atmospheric pressure.

Here, the excess ink Y which overflows from the nozzle holes 31*a* accumulates in the space S. Therefore, after the inside of the space S is under atmospheric pressure (at T4 of FIG. 9), the atmosphere release valve 55 (see FIG. 4) is released and the suction pump 16 is operated again. When air in the space S is sucked by the suction pump 16 under a state in which the atmosphere release valve 55 is released, air passes from the outside via the atmosphere release valve 55, the tubes 54*a* and 54*b*, the atmosphere communication hole 11*h*, and the atmosphere release flow path 33 toward the space S. Therefore, the ink I in the ink tank 51 is not sucked, and the pressure in the negative pressure chamber R recovers. Air which flows from the outside in the space S is discharged via the discharge hole 32*d* from the suction port 15*a* to the outside. Here, the excess ink Y which accumulates in the space S is discharged to the waste liquid tank E together with air which passes through the space S.

After that, as illustrated in FIG. 9, after a predetermined time passes, at T5, the suction pump 16 is stopped to end suction filling of the ink I. In association with the stop of the suction pump 16, the excess ink Y no longer flows out of the nozzle holes 31*a*, and the excess ink Y which remains in the negative pressure chamber R is sucked. After the filling of the ink I is completed, as illustrated in FIG. 10(*e*), the long grooves 26 are filled with the ink I.

By, simultaneously with this, causing the door 62 of the opening and closing mechanism 60 to be in the open state and causing the outer surface 62*a* of the door 62 to attract to the magnet 64, the wall portion release opening 24*n* is released and printing becomes possible. In this way, initial filling of the ink I is completed.

(In Printing)

Next, operation when printing is carried out on the box D is described. First, setting of the ink supply portion 5 is described. As illustrated in FIG. 2, the ink I is injected via the supply tubes 57*a* and 57*c* into the ink injection hole 11*d* of the ink jet head 10 by causing the supply tube 57*a* and the supply tube 57*c* to communicate with each other by the changeover valve 53.

The belt conveyor 2 is driven under a state in which the ink supply portion 5 is set as described above (see FIG. 1), the box D is transferred in one direction, and, when the transferred box D passes in front of the enclosures 6, that is, passes in front of the nozzle plates 31 (nozzle holes 31*a*), the ink discharging portions 3 discharge ink droplets toward the box D.

More specifically, based on print data which is input from an outside personal computer, the drive circuit board 14 selectively applies voltage to predetermined plate-like electrodes 28 correspondingly to the print data. This reduces the capacities of the long grooves 26 corresponding to the plate-like electrodes 28, and the ink I filled into the long grooves 26 is discharged from the nozzle orifices 31*b* toward the box D.

When the ink I is discharged, the long grooves 26 are under negative pressure, and thus, the ink I is filled into the long grooves 26 via the above-mentioned supply tubes 57*a* and 57*c*.

In this way, the ceramic piezoelectric plate 21 of the ink jet head 10 is driven according to the image data, and ink droplets are discharged from the nozzle holes 31*a* to land on the box D. In this way, by continually discharging ink droplets from the ink jet head 10 while the box D is moved, an image (text) is printed on desired locations of the box D.

(In Cleaning)

Next, operation when the ink jet head 10 is cleaned is described. First, setting of the ink supply portion 5 is described. As illustrated in FIG. 2, the supply tube 57*b* and the supply tube 57*c* are caused to communicate with each other by the changeover valve 53. By operating the suction pump 16 with this state being kept, the cleaning liquid W is injected from the cleaning liquid tank 52 via the supply tubes 57*b* and 57*c* into the ink injection hole 11*d* of the ink jet head 10. It is to be noted that, in this state, the atmosphere release valve 55 and the door 62 of the opening and closing mechanism 60 are closed.

Similarly to the case of the above-mentioned initial filling, the cleaning liquid W is caused to flow out of the nozzle holes 31*a* via the long grooves 26 and the like, and the cleaning liquid W which flows out is sucked from the suction port 15*a*.

It is to be noted that, when the ink jet recording apparatus 1 is not used for a long time, the ink I which is filled into the long grooves 26 is dried and hardened. In this case, similarly to the case of the cleaning, by filling the ink jet head 10 with the cleaning liquid W, the ink jet recording apparatus 1 may be stored for a long time.

As described above, in this embodiment, the structure having the opening and closing mechanism 60 for forming the space S (closed space) between the wall portion 24 and the nozzle plate 31 and the atmosphere release flow path 33 for communicating the space S with the outside is provided.

According to the structure, by closing the wall portion release opening 24*n* in the wall portion 24 with the opening and closing mechanism 60, the ink I may be filled and the excess ink Y which flows out of the nozzle holes 31*a* may be collected only through suction with the suction pump 16 via the suction flow path 15.

More specifically, by sucking air in the space S between the wall portion 24 and the nozzle plate 31 with the suction pump 16 under a state in which the wall portion release opening 24*n* is closed, the space S is depressurized to form the negative pressure chamber R. This enables suction filling from the ink tank 51 via the liquid supply system 12 into the long grooves 26 and the nozzle holes 31*a*. Further, by closing the wall portion release opening 24*n*, the excess ink Y which flows out of the nozzle holes 31*a* in filling the ink I may be prevented from flowing out of the wall portion release opening 24*n*. By, after the ink I is filled, sucking air in the space S with the suction pump 16 via the suction flow path 15 under a state in which the atmosphere release flow path 33 (atmosphere release valve 55) is released, air passes via the atmosphere release flow path 33 from the outside toward the space S, and thus, ink in the ink tank 51 is not sucked and the pressure in the space S recovers. After that, the air which flows from the outside into the space S is discharged to the outside via the suction flow path 15. Here, the excess ink Y which flows out of the nozzle holes 31*a* and accumulates in the space S is, together with the air which passes through the space S, discharged to the waste liquid tank E.

Therefore, contamination with the excess ink Y may be prevented with a simple structure and initial filling of the ink jet recording apparatus 1 may be achieved without providing a complicated service station as in a conventional case. Accordingly, jetting of the liquid after the ink is filled may also be stabilized. Further, the excess ink Y may be collected in the inside space of the wall portion 24, and hence the ability to collect the excess ink Y may be improved, and still, space used for collecting the excess ink Y may be extremely small, to thereby improve the space factor of the ink jet head 10. This may improve the flexibility in designing the ink jet head 10.

Further, by providing the atmosphere release flow path 33 above and providing the suction port 15*a* below, air passes from above to below (toward the suction port 15*a*) in the space S, and thus, the excess ink Y in the space S may be sucked reliably. The excess ink Y which flows out of the nozzle holes 31*a* droops down in the direction of gravity from the nozzle holes 31*a*, and hence, by providing the atmosphere release flow path 33 (atmosphere release opening 33*a*) above the nozzle column 31*c*, even if the atmosphere release opening 33*a* is released when the excess ink Y accumulates in the space S, the excess ink Y is prevented from flowing out of the atmosphere release flow path 33, and still, the space S and the outside may communicate with each other.

Here, the opening and closing mechanism 60 according to this embodiment rotates the door 62 via the hinge portions 61.

According to the structure, by rotating the door 62 via the hinge portions 61, opening and closing operation of the door 62 may be carried out smoothly. Further, by depressurizing the space S under a state in which the wall portion release opening 24*n* is closed, the space S may reliably be the negative pressure chamber R, and the ability to collect the excess ink Y may be improved. Further, by urging the door 62 in the closing direction, closing operation of the door 62 may be carried out smoothly, and, when the door 62 is in the closed state, the door 62 is urged toward the wall portion 24. Therefore, the intimate contact between the wall portion 24 and the door 62 may be secured. Further, by disposing the seal member 63 on the inner surface 62*b* of the door 62, the intimate contact between the door 62 and the end surface of the front end portion 24*q* of the wall portion 24 may be improved.

Therefore, the excess ink Y may be reliably prevented from flowing out of the wall portion release opening 24*n*. This enables prevention of leakage of air from the wall portion release opening 24*n*, and the space S may reliably be the negative pressure chamber R. Therefore, compared with a case in which the suction is carried out under a state in which the wall portion release opening 24*n* is opened, the ability to collect the excess ink Y may be improved, and at the same time, initial filling may be carried out promptly.

Further, by forming the water-repellent film on the inner surface 62*b* of the door 62, even if the excess ink Y attempts to leak to the outside from the wall portion release opening 24*n*, the excess ink Y is repelled by the water-repellent film and is more likely to remain in the space S, and thus, the ability to collect the excess ink Y is improved and the excess ink Y may be prevented from flowing out of the wall portion release opening 24*n*. Further, the excess ink Y may be prevented from remaining on the door 62, and hence, the vicinity of the ink jet head 10 may be prevented from being contaminated with the excess ink Y which remains on the door 62 when the door 62 is in the open state.

Further, the ink supply portion 5 is formed to be capable of switchedly supplying the ink I and the cleaning liquid W, and the ink I and the cleaning liquid W are supplied to the liquid supply system 12, and hence, the labor of cleaning the ink jet head 10 may be reduced and the ink jet head 10 may be cleaned efficiently.

Second Embodiment

Figure 11:
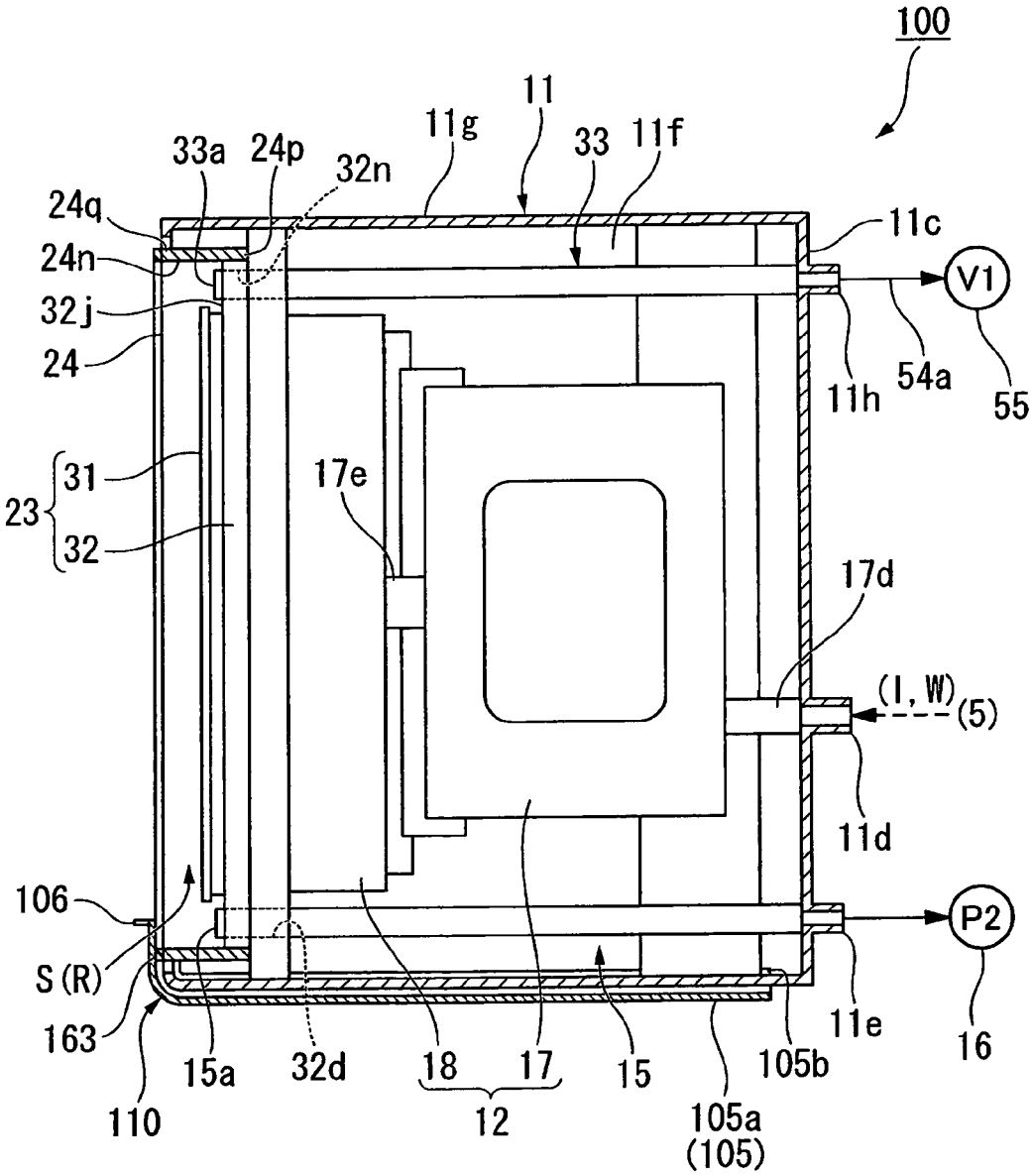
FIG. 11 is a schematic structural view of an ink jet head according to a second embodiment of the present invention viewed from a right side.
Figure 12:
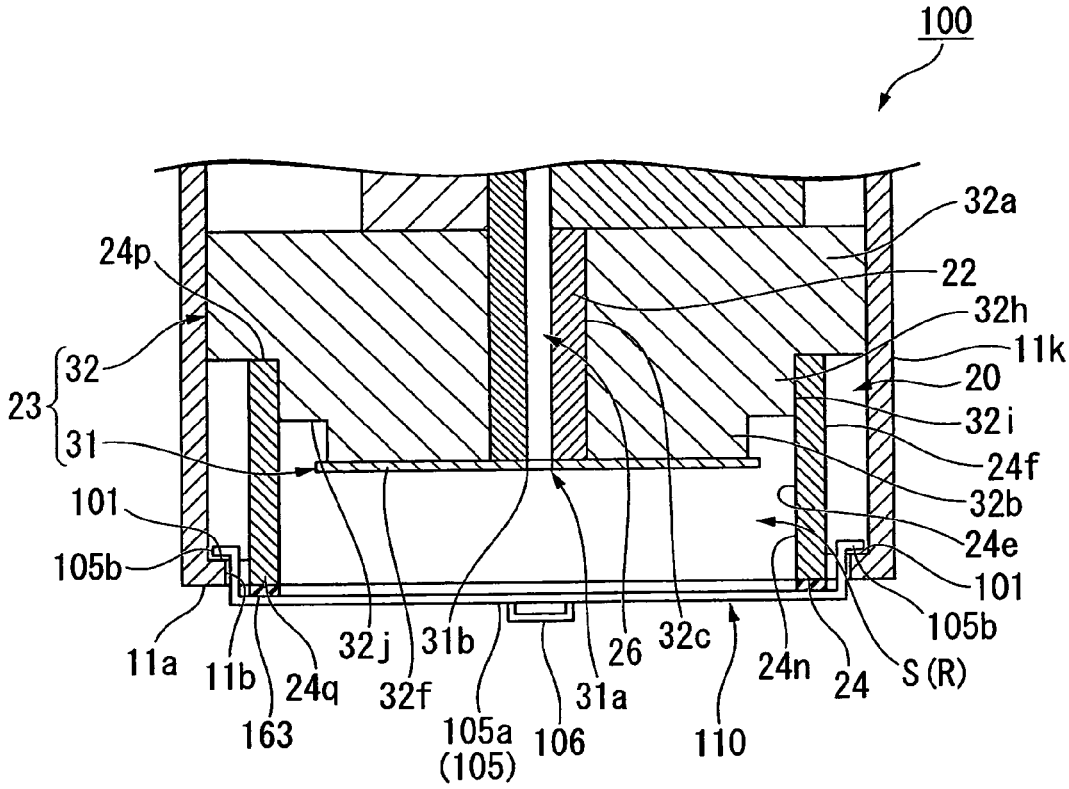
FIG. 12 is an enlarged sectional view of a principal part of the inkjet head according to the second embodiment of the present invention.

Next, the second embodiment according to the present invention is described. It is to be noted that like numerals and symbols are used to designate like or identical members in the first embodiment described above, and description thereof is omitted. FIG. 11 is a schematic structural view of an ink jet head according to the second embodiment of the present invention viewed from a right side, and FIG. 12 is an enlarged sectional view of a principal part of the ink jet head. This embodiment is different from the first embodiment described above in that the opening and closing mechanism is formed to be slidable.

As illustrated in FIGS. 11 and 12, an opening and closing mechanism 110 of an ink jet head 100 according to this embodiment includes a pair of guide portions 101, a shutter 105 supported between the guide portions 101, and a seal member 163 provided on the end surface of the front end portion 24*q* of the wall portion 24.

The guide portions 101 are provided from an upper portion of the case 11 to a lower surface of the case 11 utilizing a portion having the exposure hole 11*b* of the case 11 formed therein, which protrudes toward the inside.

The shutter 105 is housed in inside space of the guide portions 101, that is, space between the wall portion 24 and the case 11. The shutter 105 is a flexible thin plate, and includes a shutter main body 105*a* for covering the wall portion release opening 24*n* and engaging Portions 105*b* formed by bending both sides of the shutter main body 105*a* in a width direction for engaging with the guide portions 101. The shutter 105 is formed to be vertically (from a lower end to an upper end of the wall portion release opening 24*n*) slidable from the lower surface of the case 11 to the upper portion of the wall portion 24 with the engaging portions 105*b* thereof being guided by the guide portions 101. More specifically, when the shutter 105 is in a state of being disposed below the case 11 in the inside space of the guide portions 101, the shutter 105 is in an open state, and the wall portion release opening 24*n* communicates and the nozzle holes 31*a* are exposed to the outside. On the other hand, when the shutter 105 is in a state of being disposed so as to cover from the front end portion 24*q* side of the wall portion 24, the shutter 105 is in a closed state, and is formed to close the wall portion release opening 24*n* so that the space S between the wall portion 24 and the nozzle plate 31 forms closed space.

A grip portion 106 is provided on one end side of a front surface of the shutter 105, and the above-mentioned shutter 105 may be slid by operating the grip portion 106. Further, a water-repellent film (not shown) is formed by fluorine resin coating or Teflon (registered trademark) plating described above on a portion of the front surface of the shutter 105 which is opposed to the nozzle plate 31 in the closed state.

In this way, according to this embodiment, the wall portion release opening 24*n* may be opened and closed by sliding the shutter 105, and hence, compared with the structure in which the wall portion release opening 24*n* is opened and closed by rotating the door 62 (see FIG. 8) as in the first embodiment, the movable range of the opening and closing mechanism 110 in the direction of the normal to the surface of the nozzle cap 32 is small. More specifically, space used for placing the opening and closing mechanism 110 may be reduced. Therefore, the space factor may be further improved to improve the flexibility in designing the liquid jet recording apparatus.

It is to be noted that, as a modified example of the second embodiment described above, it is also possible to stop the shutter 105 in an engaged state halfway through the slide to be held under a state in which only the upper end portion of the wall portion release opening 24*n* is released. In this case, by releasing only the upper end portion from a state in which the wall portion release opening 24*n* is completely closed, the space S between the wall portion 24 and the nozzle plate 31 communicates with the outside to be released to the atmosphere. More specifically, the opening and closing mechanism may materialize the atmosphere release portion, which eliminates the necessity to provide the atmosphere release portion separately. Therefore, the space S may be released to the atmosphere without providing the atmosphere communication hole 11*h*, the atmosphere release flow path 33, and the atmosphere release valve 55 as in the first and second embodiments and without leakage of the excess ink Y which accumulates in the space S. This allows a simpler structure of the ink jet head 100 to reduce the manufacturing cost.

Third Embodiment

Figure 13:
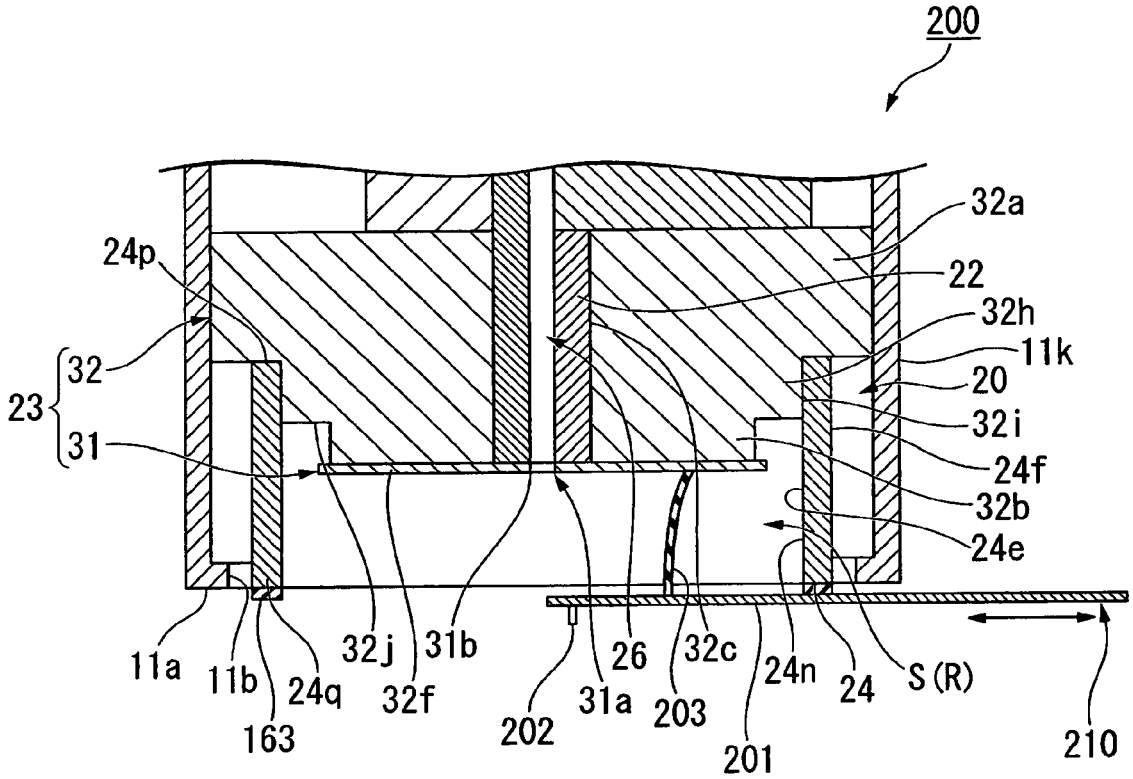
FIG. 13 is an enlarged sectional view of a principal part of an ink jet head according to a third embodiment of the present invention.

Next, a third embodiment according to the present invention is described. It is to be noted that like numerals and symbols are used to designate like or identical members in the first embodiment described above, and description thereof is omitted. FIG. 13 is an enlarged sectional view of a principal part of an ink jet head. This embodiment is different from the first and second embodiments described above in that the opening and closing mechanism is provided with a wiper member.

As illustrated in FIG. 13, an opening and closing mechanism 210 of an ink jet head 200 according to this embodiment includes a shutter 201 supported by guide portions (not shown) and the above-mentioned seal member 163.

The shutter 201 is a thin plate which is formed so that the area thereof is larger than the area of the opening of the wall portion release opening 24*n* and is formed to be guided by guide portions (not shown) provided in upper and lower portions of the case 11 and to be slidable along a width direction (in a direction of the arrow of FIG. 13) of the wall portion 24. More specifically, when the shutter 201 is in an open state, the wall portion release opening 24*n* is released and the nozzle holes 31*a* are exposed to the outside. On the other hand, when the shutter 201 is in a closed state, the shutter 201 is disposed so as to cover the wall portion release opening 24*n*, and is formed to close the wall portion release opening 24*n* so that the space S between the wall portion 24 and the nozzle plate 31 forms closed space.

A grip portion 202 is provided on a front surface of the shutter 201, and the above-mentioned shutter 201 may be slid by operating the grip portion 202. Further, a water-repellent film (not shown) is formed by fluorine resin coating or Teflon (registered trademark) plating described above on the back surface of the shutter 201.

Here, a wiper 203 is provided on one end side in a width direction of a back surface of the shutter 201 along a direction of a long side of the shutter 201. The wiper 203 is formed of an elastic material such as rubber and is provided so as to be in the wall portion release opening 24*n*, and a tip portion thereof extends to a position at which the tip portion is in contact with a surface of the nozzle plate 31. It is preferred that the wiper 203 be formed so that the length thereof is larger than that of the nozzle column 31*c* formed in the nozzle plate 31.

In this case, by carrying out the sliding operation (opening and closing operation) of the shutter 201, the wiper 203 follows the operation and horizontally slides in the wall portion release opening 24*n*, which causes the tip portion of the wiper 203 to be in sliding contact with the periphery of the nozzle holes 31*a* on the surface of the nozzle plate 31.

In this way, according to this embodiment, the wiper portion 203 is in sliding contact with the surface of the nozzle plate 31 following the opening and closing operation of the shutter 201, and hence the excess ink Y attached to the surface of the nozzle plate 31 and the excess ink Y which protrudes from the nozzle orifices 31*b* of the nozzle holes 31*a* due to surface tension may be collected at the same time of opening and closing the shutter 201. This makes it possible to effectively use the inside space of the wall portion 24, to thereby improve the space factor. Further, a wiper effect may be produced simultaneously with the opening and closing operation of the shutter 201, and hence the operating efficiency may be improved without separately providing a wiping step after the ink I is filled.

It is to be noted that the operation procedure or the shapes and combinations of the structural members described in the above-mentioned embodiments are only exemplary, and various modifications based on design requirements and the like, which fall within the gist of the present invention, are possible.

For example, in the above-mentioned embodiments, the nozzle body 23 is formed of the nozzle plate 31 and the nozzle cap 32 and the back end portion 24*p* of the wall portion 24 covers the nozzle cap 32, but the wall portion 24 may cover the nozzle plate 31 on condition that the suction port 15*a* is open to the space S.

Further, in the above-mentioned embodiments, the suction port 15*a* is formed to fit into the discharge hole 32*d* formed in the nozzle cap 32, but the discharge hole 32*d* may be formed in the nozzle plate 31 or in the wall portion 24, or, the suction flow path 15 may be connected to the discharge hole 32*d* and the discharge hole 32*d* may be the suction port.

Further, in the above-mentioned embodiments, the water-repellent film 24*h* is formed by fluorine resin coating or Teflon (registered trademark) plating, but a water-repellent sheet may be stuck, or a water-repellent agent may be applied.

Further, in the above-mentioned embodiments, the hydrophilic film 24*g* is formed by titanium coating, but gold plating may be given, or an alkaline agent may be applied.

Further, in the above-mentioned embodiments, the ink jet recording apparatus 1 is formed with the ink jet head 10 being fixed, but it is also possible to form the ink jet recording apparatus 1 with the ink jet head 10 being movable. More specifically, by adopting the ink jet head 10, an ink jet recording apparatus which eliminates the necessity of a cap for suction under negative pressure may be achieved.

Further, in the above-mentioned embodiments, the arrangement of the nozzle column 31*c* of the inkjet head 10 is provided in the direction of gravity and the openings of the nozzle holes 31*a* are provided in the horizontal direction, but the present invention is not limited thereto. The openings of the nozzle holes 31*a* may be provided in the direction of gravity and the nozzle column 31*c* may be provided to extend in the horizontal direction.

Further, in the above-mentioned embodiments, the suction pump is operated in the initial filling and in the cleaning, but there is a case in which the ink I droops from the nozzle holes 31*a* even when printing is carried out, and the ink I in such a case may be collected.

Further, in the above-mentioned embodiments, a case in which the opening and closing mechanism is provided on the wall portion 24 is described, but a structure in which a lid member or the like which is separate from the wall portion 24 closes the wall portion release opening 24*n* of the wall portion 24 is also possible.

Further, the atmosphere release flow path 33 is not necessarily required to be provided on the wall portion 24 side, and a structure in which an atmosphere release opening is provided in the opening and closing mechanism is also possible.

Further, the opening and closing operation of the lid member may be done automatically or manually.

Further, according to the present invention, the wall portion 24 is used to form the space S and the negative pressure chamber R, but the wall portion 24 may be a member which is called a nozzle guard for guarding the nozzle plate. The nozzle guard is described in detail in the following.

Figure 14:
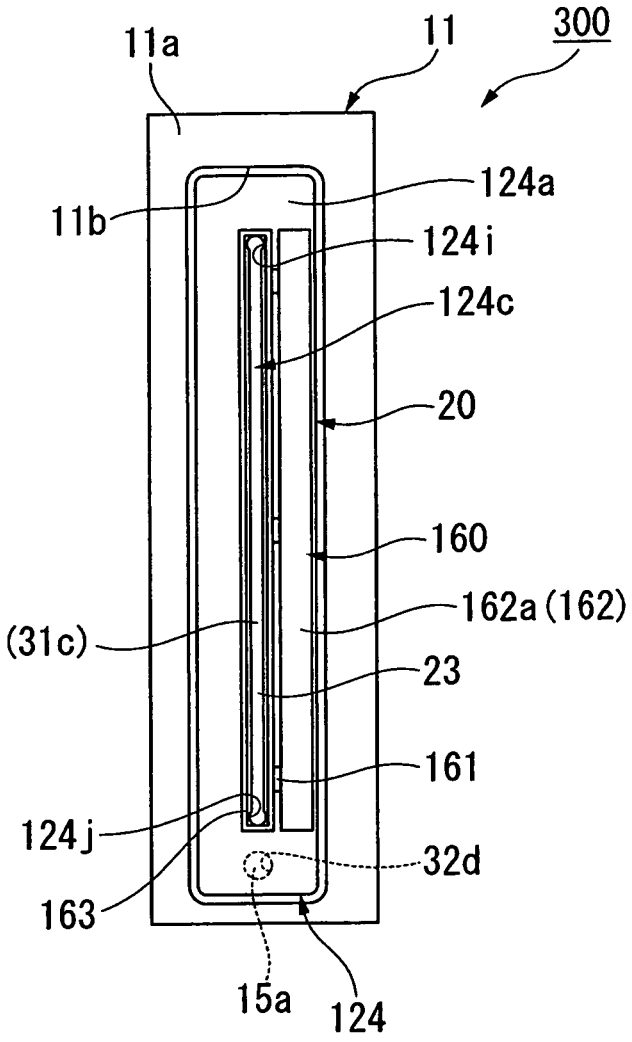
FIG. 14 is a front view of an ink jet head in another structure according to the present invention.
Figure 15:
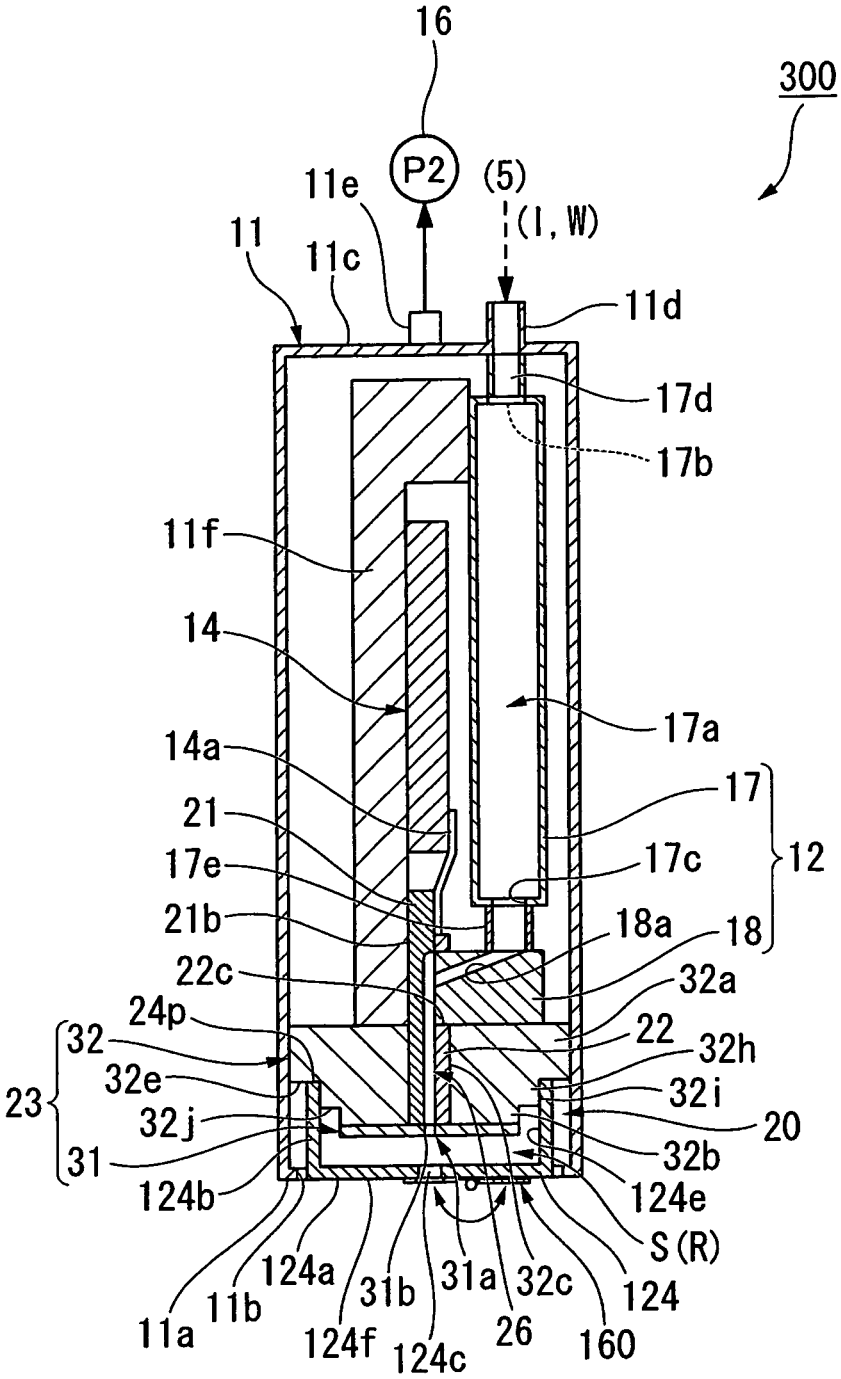
FIG. 15 is a sectional view of the ink jet head in the another structure according to the present invention.

FIG. 14 is a front view and FIG. 15 is a sectional view of an ink jet head in another structure according to the present invention. It is to be noted that like numerals and symbols are used to designate like or identical members in the first embodiment described above, and description thereof is omitted.

(Nozzle Guard)

As illustrated in FIGS. 14 and 15, a nozzle guard 124 of an ink jet head 300 is a member substantially in the shape of a box formed of stainless steel, and is formed by press forming. The nozzle guard 124 includes a top plate portion 124*a* formed so as to be rectangular-plate-like, and an airtight portion 124*b* which extends from a peripheral portion of the top plate portion 124*a* in a direction substantially orthogonal to a surface of the plate.

The top plate portion 124*a* has a plate surface the size of which is substantially the same as that of the middle frame surface 32*j*, and includes at the middle portion in the direction of a short side of the top plate portion 124*a* of a slit (opening) 124*c* which extends in the direction of a long side thereof. The slit 124*c* is formed so as to be a little longer than the nozzle column 31*c*, and both end portions (upper end portion 124*i* and lower end portion 124*j*) thereof are formed in the shape of a circle.

The width dimension of the slit 124*c* is set to be about 1.5 mm while the nozzle diameter of the nozzle holes 31*a* is 40 μm. The width dimension of the slit 124*c* is desirably set so that the upper limit thereof is the largest size at which the suction pump 16 can generate negative pressure and the lower limit thereof is the smallest size at which, in the initial filling of the ink I, the ink I does not overflow from the slit 124*c* to droop.

Further, the upper end portion 124*i* and the lower end portion 124*j* are formed in the shape of a circle the diameter of which is a little larger than the above-mentioned width dimension.

A hydrophilic film (not shown) is formed by titanium coating on an inward inner surface 124*e* of the nozzle guard 124, while a water-repellent film (not shown) is formed by fluorine resin coating or Teflon (registered trademark) plating on an outer surface 124*f* on a back surface of the inner surface 124*e* and on an inner surface of the slit 124*c*.

The back end portion 24*p* of the nozzle guard 124 is adhered to the outer frame surface 32*e* with an adhesive so that the top plate portion 124*a* covers the inner frame portion 32*b* and the discharge hole 32*d* (see FIG. 14) and so that the inner surface 124*e* of the airtight portion 124*b* and the middle side surface 32*i* of the middle frame portion 32*h* are in abutting contact with each other. In this way, the nozzle guard 124 is attached to the nozzle cap 32 so as to cover the nozzle cap 32 (see FIG. 15). In this state, the nozzle guard 124 covers the nozzle column 31*c* via space (inside space) S so that the slit 124*c* is opposed to the nozzle column 31*c* and so that the slit 124*c* is not opposed to the discharge hole 32*d*. In other words, the nozzle guard 124 covers the nozzle orifices 31*b* so that the nozzle column 31*c* is seen through the slit 124*c* and the discharge hole 32*d* is not seen through the slit 124*c* in the direction of opening of the slit 124*c* (see FIG. 14).

The distance between the top plate portion 124*a* of the nozzle guard 124 and the nozzle plate 31 is desirably set so that the upper limit thereof is the largest distance at which the suction pump 16 can generate negative pressure and the lower limit thereof is the smallest distance at which, in the initial filling of the ink I, the ink I does not overflow from the slit 124*c*.

(Opening and Closing Mechanism)

Here, an opening and closing mechanism 160 is provided on the outer surface 124*f* of the top plate portion 124*a*. The opening and closing mechanism 160 is supported by hinge portions 161 provided on the outer surface 124*f* of the top plate portion 124*a*, and includes a door (lid member) 162 formed to be capable of opening and closing the slit 124 in the top plate portion 124*a* with the hinge portions 161 being the center of rotation, urging means (not shown) for urging the door 162 in a closing direction (in a direction of closing the slit 124*c*), and a seal member 163 for sealing a gap between the door 162 in a state of closing the slit 124*c* and the top plate portion 124*a*.

The plurality of (for example, three) hinge portions 161 are arranged to a side of the slit 124*c* along the direction of the long side of the slit 124*c*, with one ends thereof being coupled to the outer surface 124*f* of the top plate portion 124*a* and the other ends thereof being coupled to the door 162.

The door 162 is a flat plate in the shape of a rectangle seen in plan view formed of a metal or the like, and the area of the door 162 is larger than the area of the opening of the slit 124*c*. The other ends of the hinge portions 161 are coupled to an outer surface of the door 162 (a surface of the door 162 located outside in the closed state), and the door 162 is formed to rotate by 180 degrees (see the arrow of FIG. 15) with the hinge portions 161 being the center of rotation. The urging means such as a torsion spring for urging the door 162 in the closing direction is disposed between the hinge portions 161 and the door 162. Further, the above-mentioned water-repellent film (not shown) is formed on an inner surface 162*a* of the door 162 (a surface of the door 162 located inside in the closed state) by fluorine resin coating or Teflon (registered trademark) plating.

The seal member 163 is formed of an elastic material such as rubber, and is disposed so as to surround the whole periphery of the slit 124*c* on the outer surface 124*f* of the top plate portion 124*a*. The seal member 163 is formed so as to be capable of, in the closed state of the door 162, being in abutting contact with the other surface of the door 162. Further, a magnet (not shown) which may cause the door 162 to attract thereto is disposed on a side opposite to the seal member 163 with respect to the hinge portions 161 in a direction of the surface of the top plate portion 124*a*. The magnet is for the purpose of, in the open state of the door 162, causing the outer surface of the door 162 to be stuck thereto to fix the door 162 in the open state, and is disposed along the direction of the long side of the slit 124*c*.

More specifically, in the open state, the door 162 is formed to expose the nozzle holes 31*a* to the outside by opening the slit 124*c*, while, in the closed state, the door 162 is formed to close the slit 124*c* so that the space S between the nozzle guard 124 and the nozzle plate 31 becomes closed space.

According to the structure, the space S communicates with the outside only via the slit 124*c*, and hence, by opening and closing only the slit 124*c* by the opening and closing mechanism 160, communication of the space S with the outside and interruption of the communication are able to be switched. In this case, compared with the structure in which the above-mentioned wall portion release opening 24*n* is opened and closed, a movable range of the door 162 in the direction of the normal to the surface of the top plate portion 124*a* is small. This may reduce space for placing the opening and closing mechanism 160, and thus, the space factor may be further improved to improve the design flexibility.

Further, when the excess ink Y is discharged, in the lower end portion 124*j* of the slit 124*c*, surface tension acts on the ink I at the contour of the circular lower end portion 124*j* (at the boundary between the outer surface 124*f* and the lower end portion 124*j*). In the lower end portion 124*j*, strong surface tension acts on the ink I and the balance of the surface tension is kept, and thus, the surface of the ink I is not broken and the ink I does not leak to the outside. Further, similarly to the case described above, the ink I is guided by the water-repellent film formed on the outer surface 124*f* and the hydrophilic film formed on the inner surface 124*e* to be returned to the negative pressure chamber R.

In this way, the excess ink Y which flows out of the nozzle holes 31*a* may be prevented from leaking via the slit 124*c* to continuously discharge the excess ink Y to the waste liquid tank E.

Further, in the opening and closing mechanism 60 according to the first embodiment described above, the hinge portions 61 protrude from the front surface 11*a* of the case 11 and the front end portion 24*q* in a direction which is substantially orthogonal to the nozzle plate 31, but the hinge portions 61 is not necessarily required to be formed to protrude. More specifically, a state in which there is no structure in a direction from the front surface 11*a* of the case 11 and the front end portion 24*q* toward the box D may be provided. Although not shown, in this case, the hinge portions 61 are formed on the side surface 11*k* of the case 11 and the hinge portions 61 are formed not to protrude from the case 11 toward the box D. Further, the shape of the door 62 may be changed depending on requirements of the opening and closing operation.

Further, in the second embodiment, also, by providing the guide portions 101 with which the engaging portions 105*b* engage at the front end portion 24*q*, a form in which the shutter 105 does not extend beyond the front surface 11*a* of the case 11 toward the box D may be achieved. Further, in the third embodiment, also, by providing in the wall portion 24 the guide portions (not shown), a form in which the shutter 201 does not extend beyond the front surface 11*a* of the case 11 toward the box D may be achieved.

By the structures described above, the distance between the front surface 11*a* of the case 11 and the box D may be made smaller, and thus, the print precision may be improved.

Further, in the above-mentioned embodiments, as illustrated in FIG. 2, the excess ink Y sucked by the suction pump 16 is discharged to the waste liquid tank E, but the present invention is not limited thereto. For example, a structure connected to the flow path on the outlet side of the suction pump 16 may be not a waste liquid tank but the ink tank 51. More specifically, the excess ink Y sucked by the suction pump 16 may be supplied to the ink tank 51 and the ink may be supplied from the ink tank 51 to the ink jet head 10 as the ink I. By adopting this form, the excess ink Y may be reused as the ink I.

In addition to this structure, in reusing the excess ink Y, a filter member may be provided in the flow path from the suction pump 16 to the ink tank 51. By adopting this structure, impurities contained in the excess ink Y may be removed and ink in an appropriate state may be supplied to the ink tank 51.

Further, in reusing the excess ink Y, a deaerator may be provided in the flow path from the suction pump 16 to the ink tank 51. By adopting this structure, air bubbles contained in the excess ink Y may be removed and ink in an appropriately deaerated state may be supplied to the ink tank 51.

However, the structures described above are not necessarily required to be used and may be appropriately used according to the specifications of a droplet jet recording apparatus.

DESCRIPTION OF SYMBOLS

1 . . . ink jet recording apparatus (liquid jet recording apparatus)
10, 100, 200, 300 . . . ink jet head (liquid jet head)
11 . . . case
11*h* . . . atmosphere communication hole (atmosphere release portion)
12 . . . liquid supply system
15 . . . suction flow path
15*a* . . . suction port
16 . . . suction pump (sucking portion)
21 . . . ceramic piezoelectric plate (actuator)
23 . . . nozzle body (jetting body)
24 . . . wall portion (jetting body guard)
24*n* . . . wall portion release opening (opening)
124*a* . . . top plate portion
124*b* . . . airtight portion
124*c* . . . slit (opening)
33 . . . atmosphere release flow path (atmosphere release portion)
26 . . . long groove (pressure generating chamber)
31*a* . . . nozzle hole
31*b* . . . nozzle orifice (nozzle)
31*c* . . . nozzle column (jetting hole column)
32*k* . . . groove
60, 110, 210 . . . opening and closing mechanism
61 . . . hinge portion
62 . . . door (lid member)
63 . . . seal member
105, 201 . . . shutter (lid member)
I . . . ink (first liquid)
R . . . negative pressure chamber
S . . . space (inside space)
W . . . cleaning liquid (second liquid)

The invention claimed is:

1. A liquid jet head comprising:

a jetting body having a jetting hole column formed of a plurality of jetting holes;

a plurality of pressure generating chambers communicating with respective ones of the plurality of jetting holes;

a liquid supply system for supplying a liquid to the plurality of pressure generating chambers and the plurality of jetting holes;

an actuator disposed adjacent to the plurality of pressure generating chambers, the actuator being configured to be driven to pressurize the plurality of pressure generating chambers to thereby cause the liquid to be jetted from liquid nozzles of the plurality of jetting holes;

a wall portion surrounding a periphery of the jetting body and having an opening opposed to the plurality of jetting holes;

an opening and closing mechanism configured to undergo an opening operation to open the opening of the wall portion to expose the plurality of jetting holes to an exterior of the liquid jet head, and configured to undergo a closing operation to close the opening of the wall portion to form a closed space between the wall portion and the jetting body;

a suction flow path having on one end side thereof a suction port opening below the jetting hole column, another end side of the suction flow path being connected to a suction portion configured to evacuate an inside of the closed space between the wall portion and the jetting body to cause the closed space to become a negative pressure chamber to supply the liquid from a supply source to the plurality of pressure generating chambers and to the plurality of jetting holes; and an atmosphere release portion configured to switch between opening and closing communication of the closed space with the exterior of the liquid jet head.

2. A liquid jet head according to claim 1; wherein when the jetting hole column is disposed in a vertical direction, the atmosphere release portion is provided above and aligned with the jetting hole column.

3. A liquid jet head according to claim 1; wherein the opening and closing mechanism comprises a lid member supported by a hinge portion, the hinge portion being provided on the wall portion or a case for supporting the wall portion, the lid member being configured to undergo rotational movement to open and close the opening of the wall portion with the hinge portion as a center of rotation.

4. A liquid jet head according to claim 3; wherein the opening and closing mechanism comprises urging means for urging the lid member in a direction of closing the opening of the wall portion.

5. A liquid jet head according to claim 1; wherein the opening and closing mechanism comprises a lid member configured to slide in directions of opening and closing the opening of the wall portion and a guide portion for guiding the lid member.

6. A liquid jet head according to claim 5; wherein the lid member has a wiper member configured for sliding contact with a periphery of the plurality of jetting holes during the opening and closing operation.

7. A liquid jet head according to claim 6; wherein the lid member is configured to undergo sliding movement from below to above the jetting body in a direction of gravity.

8. A liquid jet head according to claim 7; further comprising a seal member disposed between the lid member and the wall portion in a state of closing the opening of the wall portion.

9. A liquid jet head according to claim 8; further comprising a water-repellent film formed on a surface of the lid member opposed to the jetting body in a state of closing the opening of the wall portion.

10. A liquid jet head according to claim 9; wherein the wall portion comprises a top plate portion, the top plate portion being disposed apart from a surface of the jetting body and having the opening formed therein so as to be opposed to the plurality of jetting holes, and an airtight portion for hermetically sealing a space between a peripheral portion of the top plate portion and the jetting body.

11. A liquid jet recording apparatus comprising: a liquid jet head according to claim 1; and a liquid supply portion configured to supply the liquid to the liquid supply system.

12. A liquid jet recording apparatus according to claim 11; wherein the liquid comprises a first liquid; and wherein the liquid supply portion is configured to switchedly supply the first liquid and the second liquid to the liquid supply system.

13. A liquid jet recording apparatus according to claim 12; wherein the liquid jet recording apparatus has the suction portion connected to the suction flow path to cause the closed space between the wall portion and the jetting body to be a negative pressure chamber and configured to remove the first liquid from the supply source of the first liquid.

14. A liquid jet recording apparatus according to claim 13; further comprising a reuse liquid supply system configured to collect by suction the first liquid overflowing in the negative pressure chamber and to supply the first liquid to the plurality of pressure generating chambers.

15. A liquid jet recording apparatus according to claim 14; wherein the reuse liquid supply system comprises a filter portion or a deaerator.

16. A method of filling a liquid jet head with liquid, comprising:

providing a liquid jet head comprising: a jetting body having a plurality of jetting holes; a plurality of pressure generating chambers communicating with respective ones of the plurality of jetting holes; a liquid supply system for supplying a liquid to the plurality of pressure generating chambers and the plurality of jetting holes; an actuator disposed adjacent to the plurality of pressure generating chambers, the actuator being configured to be driven to pressurize the plurality of pressure generating chambers to thereby cause the liquid to be jetted from liquid nozzles of the plurality of jetting holes; a wall portion surrounding a periphery of the jetting body and having an opening opposed to the plurality of jetting holes; an opening and closing mechanism configured to undergo an opening operation to open the opening of the wall portion to expose the plurality of jetting holes to an exterior of the liquid jet head, and configured to undergo a closing operation to close the opening of the wall portion to form a closed space between the wall portion and the jetting body; a suction flow path having on one end side thereof a suction port opening below the plurality of jetting holes for communication with the closed space formed between the wall portion and the jetting body, another end side of the suction flow path being connected to a suction portion configured to evacuate an inside of the closed space to cause the closed space to become a negative pressure chamber to supply the liquid from a supply source; and an atmosphere release portion configured to switch between opening and closing communication of the closed space formed between the wall portion and the jetting body with the exterior of the liquid jet head;

causing the opening and closing mechanism to perform a closing operation to close the opening of the wall portion;

in the closed state of the opening of the wall portion, causing the atmosphere release portion to perform a switching operation to close communication of the closed space formed between the wall portion and the jetting body with the exterior of the liquid jet head, and causing the suction portion to carry out via the suction flow path suction filling of the liquid from the supply source into the plurality of pressure generating chambers and the plurality of jetting holes; and after the suction filling of the liquid and while in the closed state of the opening of the wall portion, causing the atmosphere release portion to perform a switching operation to open communication of the closed space formed between the wall portion and the jetting body with the exterior of the liquid jet head, and causing the suction portion to remove via the suction flow path an excess of the liquid existing in the closed space.

17. A liquid jet head comprising:

a nozzle plate having a nozzle hole column formed of a plurality of nozzle holes being configured so that a liquid is ejected from the plurality of nozzle holes;

a wall portion surrounding a periphery of the nozzle plate and having an opening opposed to the plurality of nozzle holes;

an opening and closing mechanism configured in an open state thereof to open the opening of the wall portion to expose the plurality of nozzle holes to an exterior of the liquid jet head, and configured in a closed state of the opening and closing mechanism to close the opening of the wall portion to form a closed space between the wall portion and the nozzle plate;

a suction channel having on one end side thereof a suction port opening below the nozzle hole column, another end side of the suction channel being connected to a suction pump configured to evacuate the closed space formed between the wall portion and the nozzle plate to convert the closed space to a negative pressure chamber to thereby supply the liquid to the plurality of nozzle holes; and an atmosphere release channel configured to switch the opening and closing mechanism between the open state and the closed state thereof.

18. A liquid jet head according to claim 17; wherein when the nozzle hole column is disposed in a vertical direction, the atmosphere release channel is provided above and aligned with the nozzle hole column.

19. A liquid jet recording apparatus comprising: a liquid jet head according to claim 17, the liquid jet head further comprising a plurality of pressure generating chambers communicating with respective ones of the plurality of nozzle holes, and a liquid supply system for supplying the liquid to the plurality of pressure generating chambers and the plurality of nozzle holes; and a liquid supply portion configured to supply the liquid to the liquid supply system of the liquid jet head.

20. A liquid jet recording apparatus according to claim 19; wherein the liquid jet recording apparatus has the suction pump connected to the suction channel.

* * * * *